US009021630B2

(12) United States Patent
Scarleski

(10) Patent No.: US 9,021,630 B2
(45) **Date of Patent: *May 5, 2015**

(54) BEDMAKER

(75) Inventor: William John Scarleski, Chicago, IL (US)

(73) Assignee: Levitation Sciences LLC, Chicago, IL (US)

( * ) Notice: Subject to any disclaimer, the term of this patent is extended or adjusted under 35 U.S.C. 154(b) by 223 days.

This patent is subject to a terminal disclaimer.

(21) Appl. No.: 13/534,674

(22) Filed: Jun. 27, 2012

(65) Prior Publication Data

US 2012/0260432 A1 Oct. 18, 2012

Related U.S. Application Data

(63) Continuation-in-part of application No. 13/078,385, filed on Apr. 1, 2011, now Pat. No. 8,246,706, which is a continuation of application No. 12/772,572, filed on May 3, 2010, now Pat. No. 8,006,331.

(51) Int. Cl.
*A47C 21/06* (2006.01)
*A47C 21/00* (2006.01)

(52) U.S. Cl.
CPC ..... *A47C 21/00* (2013.01); *A47C 21/06* (2013.01)

(58) Field of Classification Search
CPC ..... A47C 21/028
USPC ..... 5/81.1 HS, 81.1 RP, 488, 510, 511, 658, 5/659, 926, 411; 414/676
See application file for complete search history.

(56) References Cited

U.S. PATENT DOCUMENTS

| | | | |
|---|---|---|---|
| 2,849,729 | A | 9/1958 | Goodey, Jr. et al. |
| 3,261,177 | A | 7/1966 | Amann et al. |
| 3,416,626 | A | 12/1968 | Nagamatsu |
| 3,667,073 | A | 6/1972 | Renfro |
| 4,046,317 | A | 9/1977 | Hein, Jr. |
| 4,095,299 | A | 6/1978 | Schweiso |
| 4,155,421 | A | 5/1979 | Johnson et al. |
| 4,517,690 | A | 5/1985 | Wegener |
| 4,944,053 | A | 7/1990 | Smith |
| 5,022,110 | A | 6/1991 | Stroh |
| 5,088,952 | A | 2/1992 | Goldblatt |
| 5,168,589 | A | 12/1992 | Stroh et al. |
| 5,257,430 | A | 11/1993 | Yamaguchi |

(Continued)

FOREIGN PATENT DOCUMENTS

| | | |
|---|---|---|
| EP | 1 106 115 | 6/2001 |
| EP | 1 645 258 | 4/2006 |

OTHER PUBLICATIONS

ISR PCT/US13/47883, Oct. 31, 2013.

(Continued)

*Primary Examiner* — Michael Trettel
(74) *Attorney, Agent, or Firm* — John S. Paniaguas; Clark Hill PLC

(57) ABSTRACT

Levitation devices are disclosed for use with beds. In one embodiment, the levitation device is configured to facilitate rotation of a mattress with respect to a box spring. In another embodiment, the levitation device is configured to facilitate making a bed which allows sheets and blankets to be tucked between the mattress and the box spring without the need to lift the mattress. In a third embodiment, the levitation device functions as a hybrid device and can be used for making a bed or rotating a mattress.

56 Claims, 21 Drawing Sheets

(56) References Cited

U.S. PATENT DOCUMENTS

| | | | |
|---|---|---|---|
| 5,313,679 | A | 5/1994 | Yamaguchi |
| 5,318,481 | A | 6/1994 | St-Germain |
| 5,360,363 | A | 11/1994 | Levin |
| 5,414,882 | A | 5/1995 | Goodale |
| 5,473,783 | A | 12/1995 | Allen |
| 5,628,077 | A | 5/1997 | Briganti |
| 5,631,074 | A | 5/1997 | Herlihy |
| 5,632,054 | A | 5/1997 | Hutton et al. |
| 5,815,865 | A | 10/1998 | Washburn et al. |
| 5,860,174 | A | 1/1999 | Failor |
| 6,073,291 | A | 6/2000 | Davis |
| 6,274,520 | B1 | 8/2001 | Cordell |
| 6,457,196 | B1 | 10/2002 | Dykes et al. |
| 6,684,434 | B2 | 2/2004 | Ellis et al. |
| 6,728,978 | B1 | 5/2004 | Nordin |
| 6,795,989 | B2 | 9/2004 | Fairchild et al. |
| 6,886,203 | B2 | 5/2005 | Drakos et al. |
| 6,966,083 | B1 | 11/2005 | Cheng |
| 7,051,388 | B1 | 5/2006 | Taddeo |
| 7,120,952 | B1 | 10/2006 | Bass et al. |
| 7,155,763 | B2 | 1/2007 | North |
| 7,481,290 | B2 | 1/2009 | Pendzich |
| 7,581,270 | B1 | 9/2009 | Levesque |
| 7,617,556 | B2 | 11/2009 | Rensink |
| 7,644,671 | B2 | 1/2010 | Smith |
| 7,725,963 | B2 | 6/2010 | Johnson |
| 7,730,567 | B2 | 6/2010 | Jaeger |
| 7,735,164 | B1 | 6/2010 | Patrick |
| 7,849,533 | B1 | 12/2010 | Receveur et al. |
| 7,917,979 | B2 | 4/2011 | Amsler, Jr. et al. |
| 7,975,330 | B2 | 7/2011 | Receveur et al. |
| 8,006,331 | B1 | 8/2011 | Scarleski |
| 8,122,541 | B1 | 2/2012 | Georgatos |
| 8,201,292 | B2 | 6/2012 | Dionne et al. |
| 8,246,706 | B2 | 8/2012 | Scarleski |
| 8,510,880 | B2 | 8/2013 | Scarleski |
| 8,549,681 | B2 | 10/2013 | Scarleski |
| 2003/0029062 | A1 | 2/2003 | Esterman |
| 2003/0079292 | A1 | 5/2003 | Ellis et al. |
| 2004/0133978 | A1 | 7/2004 | Fairchild et al. |
| 2004/0226089 | A1 | 11/2004 | Miranda |
| 2005/0172412 | A1 | 8/2005 | Pearson |
| 2005/0229318 | A1 | 10/2005 | Peng |
| 2006/0010608 | A1 | 1/2006 | DeFranks et al. |
| 2007/0022533 | A1 | 2/2007 | Borino |
| 2007/0251017 | A1 | 11/2007 | Speer et al. |
| 2008/0028522 | A1 | 2/2008 | Atwood |
| 2008/0040858 | A1 | 2/2008 | Sakaldasis et al. |
| 2008/0096001 | A1 | 4/2008 | Emden et al. |
| 2008/0141463 | A1 | 6/2008 | Dionne |
| 2008/0264983 | A1 | 10/2008 | Kastan |
| 2008/0301876 | A1 | 12/2008 | Kenalty et al. |
| 2009/0004452 | A1 | 1/2009 | Assink |
| 2009/0056030 | A1 | 3/2009 | Bolden |
| 2009/0083909 | A1 | 4/2009 | Amsler |
| 2009/0106893 | A1 | 4/2009 | Blevins |
| 2010/0258344 | A1 | 10/2010 | Creasy |
| 2011/0041247 | A1 | 2/2011 | Moon |
| 2011/0099713 | A1 | 5/2011 | Gonser |
| 2011/0265268 | A1 | 11/2011 | Scarleski |
| 2011/0265269 | A1 | 11/2011 | Scarleski |
| 2011/0278888 | A1 | 11/2011 | Miles |
| 2012/0117778 | A1 | 5/2012 | Scarleski |
| 2012/0137433 | A1 | 6/2012 | Snell et al. |
| 2012/0174323 | A1 | 7/2012 | Platek |
| 2012/0246834 | A1 | 10/2012 | Scarleski |
| 2012/0260432 | A1 | 10/2012 | Scarleski |
| 2013/0019411 | A1 | 1/2013 | Scarleski |
| 2013/0212809 | A1 | 8/2013 | Scarleski |
| 2013/0232698 | A1 | 9/2013 | Ward |
| 2014/0026318 | A1 | 1/2014 | Bethel et al. |

OTHER PUBLICATIONS

U.S. Appl. No. 12/772,572, filed May 3, 2010, William J. Scarleski.
U.S. Appl. No. 13/360,049, filed Jan. 27, 2012, William J. Scarleski.
U.S. Appl. No. 13/360,090, filed Jan. 27, 2012, William J. Scarleski.
U.S. Appl. No. 14/015,223, William J. Scarleski.
U.S. Appl. No. 13/796,434, filed Mar. 12, 2013, William J. Scarleski.
U.S. Appl. No. 13/838,408, filed Mar. 15, 2013, William J. Scarleski.
U.S. Appl. No. 14/046,047, William J. Scarleski.
U.S. Appl. No. 14/046,113, William J. Scarleski.
ISR PCT/US2011/34537, May 16, 2011.
ISR PCT/US2011/34511, Aug. 1, 2011.
http:/questoutfitters.com/coated.html—May 6, 2010.
http:/www.rockywoods.com—May 6, 2010.
http:/www.rockywoods.com/Fabrics-Hardware-Patterns-Kits/Medium-Weight-Nylon-Fabrics/Heat-Sealable-70-Denier-Nylon-Taffeta—May 6, 2010.
http:/www2.dupont.com/Products_and_Services/en VN/nwyn.html—May 6, 2010.
http:/www.seattlefabrics.com/nylons.html—May 6, 2010.
http:/www.mattressdirectonline.com—May 5, 2010.
http:/www.nextag.com/INVACARE-MicroAir-Lateral-Rotation-628052627/prices-html Sep. 14, 2009.
http:/uncyclopedia.wikia.com/wiki/Mattress_racing—Sep. 14, 2009.
http:/www.primeconveyor.com/productDetail.asp_Q_catID_E_92_A_subCatID_E_129_. . . Sep. 14, 2009.
U.S. Appl. No. 13/628,427, filed Sep. 2012, Scarleski.

BEDMAKER

CROSS REFERENCE TO RELATED APPLICATIONS

This application is a continuation-in-part of U.S. patent application No. 13/078,385filed Mar. 1, 2011, now U.S Pat. No. 8,246,706, which, in turn, is a continuation of U.S. patent application Ser. No. 12/772,572filed May 3, 2010, now U.S. Pat. No. 8,006,331.

BACKGROUND OF THE INVENTION

1. Field of the Invention

The present invention relates to a system and method for facilitating making beds of all sizes with one or more flat sheets by minimizing lifting of the mattress so that flat sheets and/or blankets can be tucked between the upper mattress and the box spring or platform without lifting the top mattress. 2. Description of the Prior Art.

A conventional bed includes a box spring or bottom mattress or platform and a top mattress. Top mattresses are relatively heavy items. The weight of a mattress varies as a function of the coil core, the gauge of the coil and the type of material or foam material used. An average king size mattress weighs between 85 and 115 pounds, High end king size mattresses with latex or memory foam can weigh as much as 300 pounds www.mattressdirectonline.com.

Hotel and motel chains as well as healthcare facilities which include hospitals, nursing homes and extended care facilities (hereinafter "commercial facilities") are known to only use flat sheets in their facilities due to the lower cost of flat sheets relative to fitted sheets and the desire to maintain fewer items in their respective inventories. As such, in order to properly make the beds in such facilities with flat sheets, housekeeping personnel need to lift the top mattress, which can be quite heavy, as discussed above. More particularly, in such facilities beds are made with a top sheet and a bottom sheet and a blanket. Both the top sheet and the bottom sheets are flat sheets.

In order to properly make the bed, the top and bottom sheets are tucked in between the top mattress and the box spring. More specifically, the bottom sheet is placed on the bed so that an equal amount of the sheet hangs off each side of the bed and an equal amount of the sheet hangs off the head and foot regions of the bed. The excess is tucked in at the head and foot regions of the bed to form so called "hospital corners". Next, the excess portions of the bottom sheet are tucked in next between the mattress and the box spring. The top sheet is then placed on top of the bottom sheet and placed and tucked in the same manner as the bottom sheet with hospital style corners except the head region is left open. In other words, only the foot and side portions of the top sheet are tucked between the mattress and the box spring. Next, a blanket is placed on the bed and may be tucked in the same manner as the top sheet.

In order to tuck the top and bottom sheets between the mattress and the box spring, the top mattress must normally be lifted. As mentioned above, mattresses can weigh up to 300 pounds. In order to make a bed, a housekeeping employee may need to lift a mattress up to ten (10) times per bed-four (4) times for the bottom sheet and three (3) times for the top sheet and the blanket. Assuming that each housekeeping employee in a hotel, motel or healthcare facility makes at least 20-30 beds in a single shift, each housekeeping employee would typically lift a mattress at least 150-200 times per shift. Since bed making is a daily chore, housekeeping employees probably lift mattresses 150-200 times per shift on a daily basis.

Such sustained and repetitive lifting leads to employees developing back problems, resulting in employees missing work or, in severe cases, being placed on disability. Measures have been taken to mitigate such health problems. For example, simply using fitted sheets for the lower sheet reduces the number of times the mattress is to be lifted by 40%. However, fitted sheets do not provide the "hospital corners" in the lower bed sheets that hospitals are known for. Moreover, even using fitted sheets for the bottom sheet still requires a housekeeping employee to lift mattresses at least 90-160 times per day using the example above.

The use of fitted sheets is not without its drawbacks. For example, fitted sheets cost more than flat sheets. Also, frequent washing of sheets in commercial facilities tends to wear out the elastic in fitted sheets. As such, fitted sheets used in such facilities need to be replaced in applications in commercial facilities more frequently than straight sheets.

Thus, there is a need for further minimizing or eliminating the need for housekeeping employees to lift mattresses while still providing "hospital corners" on the made beds.

SUMMARY OF THE INVENTION

Briefly, the present invention relates to a system and method for facilitating making beds of all sizes with one or more flat sheets by minimizing lifting of the mattress so that flat sheets and/or blankets can be tucked between the upper mattress and the box spring or platform without lifting the top mattress. As such, during an active mode, flat sheets and blankets can be tucked between a mattress and box spring or platform virtually effortlessly without the need to lift the top mattress. The present invention thus increases the efficiency of the housekeeping staff leaving more time for the housekeeping staff to attend to the rest of the room.

DESCRIPTION OF THE DRAWING

These and other advantages of the present invention will be readily understood with reference to the following specification and attached drawing wherein.

DETAILED DESCRIPTION

Figure 44:
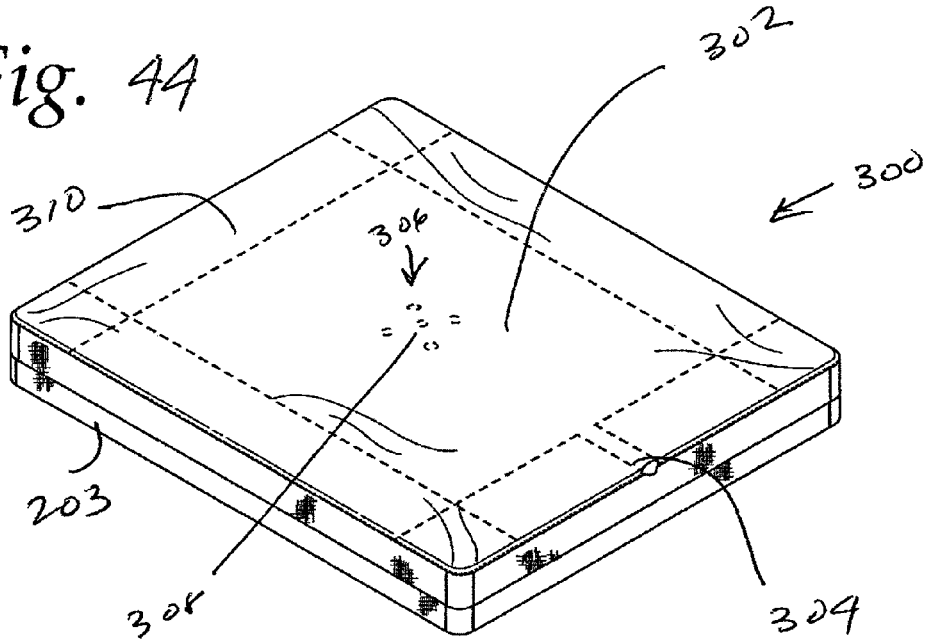
FIG. 44 is an isometric view of a levitation device installed on a box spring with an alternate exemplary pattern for the levitation device shown in phantom.
Figure 45:
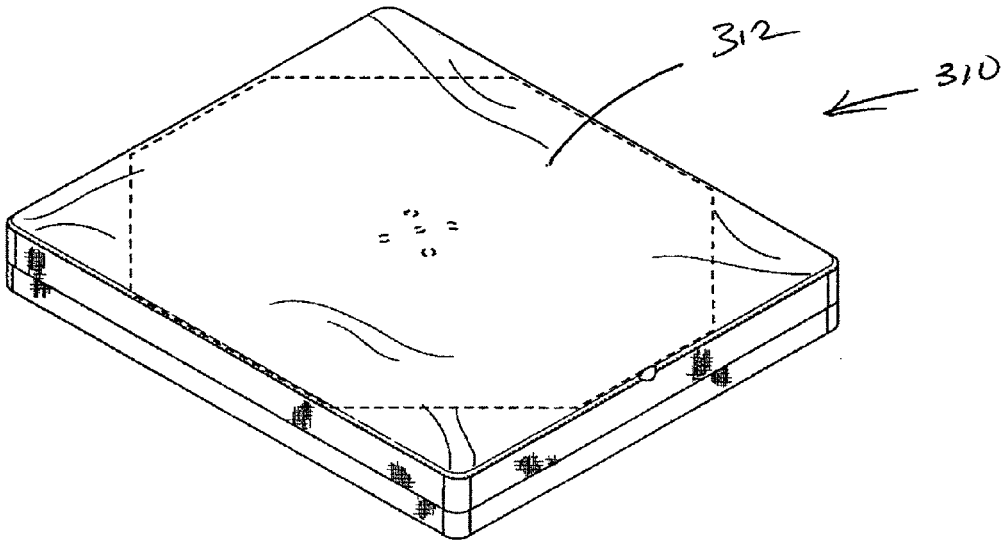
FIG. 45 is an isometric view of a levitation device installed on a box spring with another alternate exemplary pattern for the levitation device shown in phantom.

The present invention relates to levitation devices that can be used for making beds and rotating mattresses in a horizontal plane. FIGS. 1-29 relate to an active mattress spinner for rotating mattresses in a horizontal plane. FIGS. 30-43 relate to a method for facilitating making a bed without the need to lift the top mattress. FIGS. 44 and 45 illustrate alternate embodiments of the levitation device for both of the embodiments discussed above.

Bed Maker™

A system and method are disclosed for facilitating making beds of all sizes with one or more flat sheets by minimizing lifting of the top mattress so that flat sheets and/or blankets can be tucked between the upper mattress and the box spring or platform without lifting the top mattress. As used herein, box spring is to be understood to be a box spring or a platform.

More particularly, the present invention relates to a levitation device that can be centrally located between the mattress and the box spring. The levitation device is driven by an air source, such as an air pump or other source of air, and has a normal mode and an active mode. In a normal mode, the air source is off and the levitation device is relatively flat. In an active mode, the air source is on and the levitation device is expanded lifting the top mattress relative to the box spring. By centrally locating the levitation device relative to the mattress and the box spring, a portion of the mattress is lifted, thus relieving the weight of mattress along the edges. As such, during an active mode, flat sheets and blankets can be tucked between a mattress and box spring virtually effortlessly without the need to lift the top mattress. When the bed is made the air source is simply turned off allowing the mattress to be lowered onto the box spring.

Figure 40:
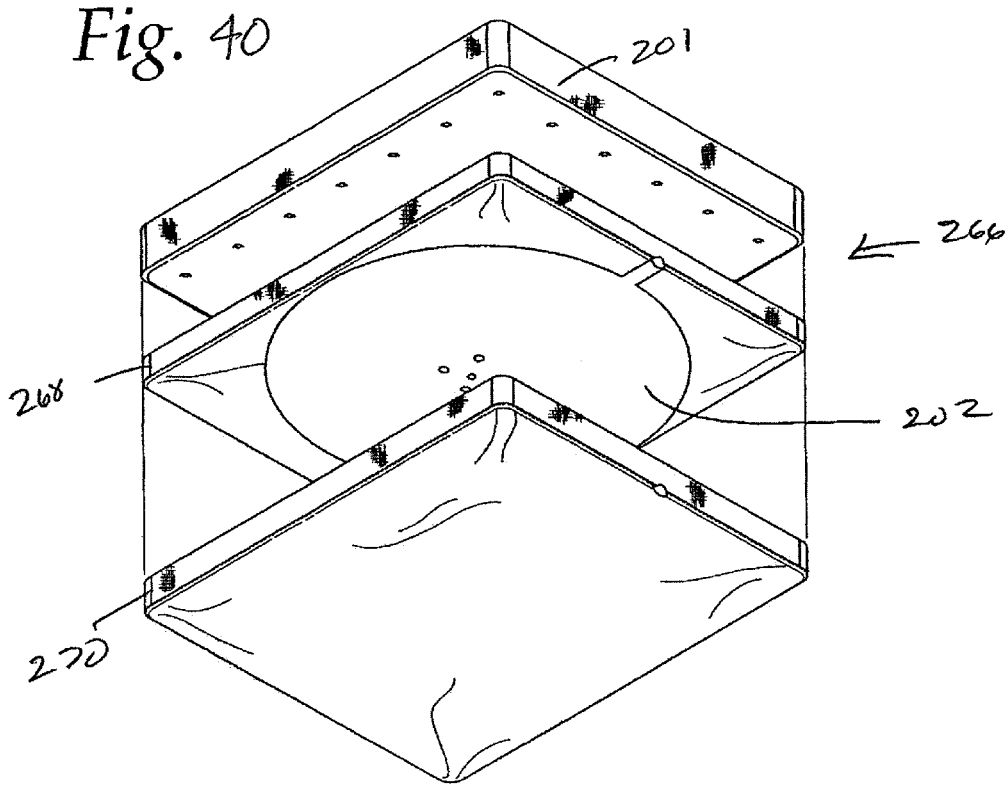
FIG. 40 is an exploded isometric view of another alternate embodiment of the levitation device illustrated in FIG. 30 in which the levitation device is configured as an after-market device that is installable on either mattress or the box spring in the same manner as a conventional sheet in which the levitation device is formed from two (2) covers.
Figure 41:
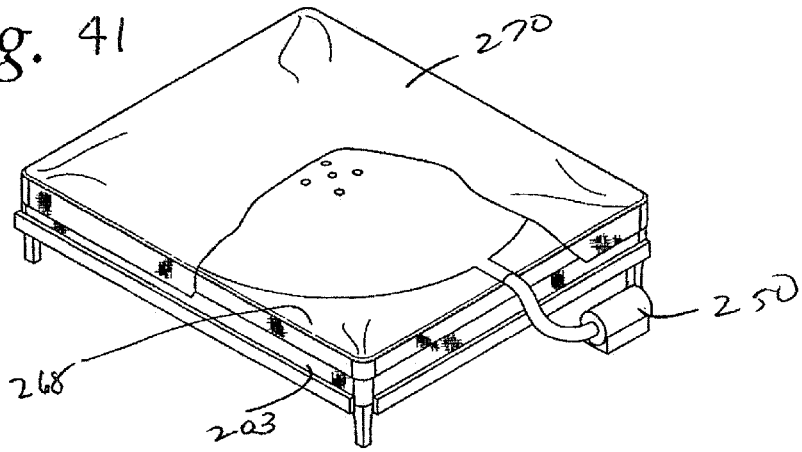
FIG. 41 is an isometric view of the aftermarket levitation device, illustrated in FIG. 40, installed on a box spring and shown with a portion of the top cover removed.

As mentioned above, this embodiment is illustrated in FIGS. 30-43. In particular, FIGS. 30-37 illustrate an embodiment in which the levitation device is embedded into one or the other of a mattress or a box spring. FIGS. 38, 39, 42 and 43 illustrate an aftermarket embodiment in which the levitation device is formed as a single cover that can easily be installed on either the mattress or the box spring by a consumer or a commercial facility. FIGS. 40 and 41 illustrate an alternative aftermarket device formed as two covers.

The invention described herein is useful when a bed is properly made, as discussed above, with one or more flat sheets. As used herein, flat sheets are defined to mean a rectangular sheet of cloth having a standard size for covering a standard mattress as described below.

US standard mattress sizes and US standard flat sheet sizes are provided below. It is to be noted that the principles of the invention are also applicable to non-US mattress and flat sheet sizes, as well as non-standard sizes and also apply to so-called "deep pocket" mattresses and flat sheets.

TABLE 1

US Standard Mattress Sizes

| Common Term | Size in inches | Size in Centimeters |
|---|---|---|
| Twin | 39 × 75 | 99 × 190 |
| X-Long Twin | 39 × 80 | 99 × 203 |
| Full | 54 × 75 | 137 × 190 |
| Queen | 60 × 80 | 153 × 203 |
| King | 76 × 80 | 198 × 203 |
| California King | 72 × 84 | 182 × 213 |

TABLE 2

US Standard Flat Sheet Sizes

| Common Term | Size in inches | Size in Centimeters |
|---|---|---|
| Twin | 66 × 96 | 167 × 243 |
| X-Long Twin | 66 × 102 | 167 × 259 |
| Full | 81 × 96 | 205 × 243 |
| Queen | 90 × 102 | 228 × 259 |
| King | 108 × 102 | 274 × 259 |
| California King | 108 × 102 | 274 × 259 |

Referring first to FIGS. 30-37, a first embodiment of the BedMaker™ device is illustrated. In this embodiment, the levitation device may be embedded in either the underside of the mattress or the top side of the box spring. As defined herein, "embedded" is defined to mean permanently attached, for example, by stitching, or removably attached using a fastener system, such as a zipper or a Velcro® fastening system to the surface of a box spring or mattress. Moreover, although the various embodiments, illustrated in FIGS. 30-43, show the air flow from the levitation device in an upward direction, the principles of the invention are applicable to embodiments in which the air flow from the levitation device is in a generally downward or upward direction.

Figure 30:
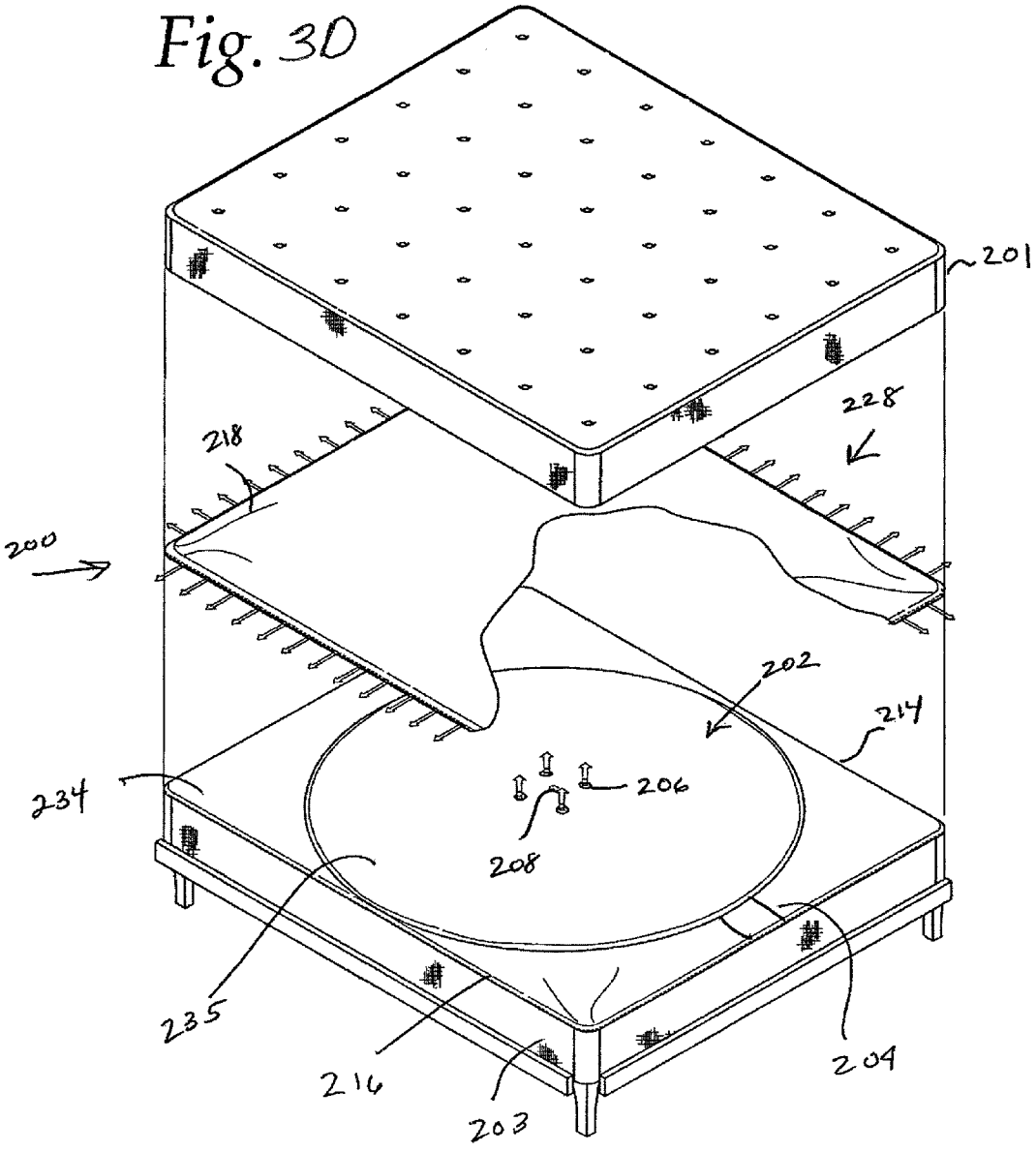
FIG. 30 is an exploded isometric view of an embodiment of an invention that facilitates making a bed in which a levitation device can be embedded in either the box spring or the mattress; shown with the levitation device embedded in the box spring.

Referring first to FIG. 30, a top mattress 201 and a box spring 203 are shown. The levitation device is generally identified with the reference numeral 200. The levitation device 200 includes an inflatable volume generally identified with the reference numeral 202. As shown in FIG. 30, the inflatable volume may be formed with a circular shape, as shown in FIG. 30 or rectangular or octagonal shapes, as shown in FIGS. 44 and 45, respectively or virtually any shape.

Figure 33:
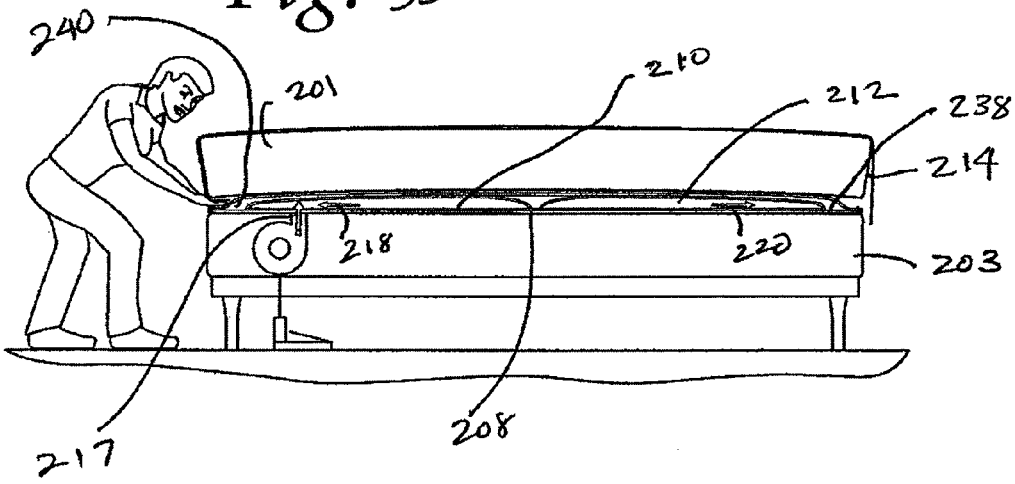
FIG. 33 is similar to FIG. 31 and illustrates a user tucking a sheet or blanket between one end of a mattress and a box spring, shown with an embodiment in which the levitation device is embedded in the box spring.
Figure 34:
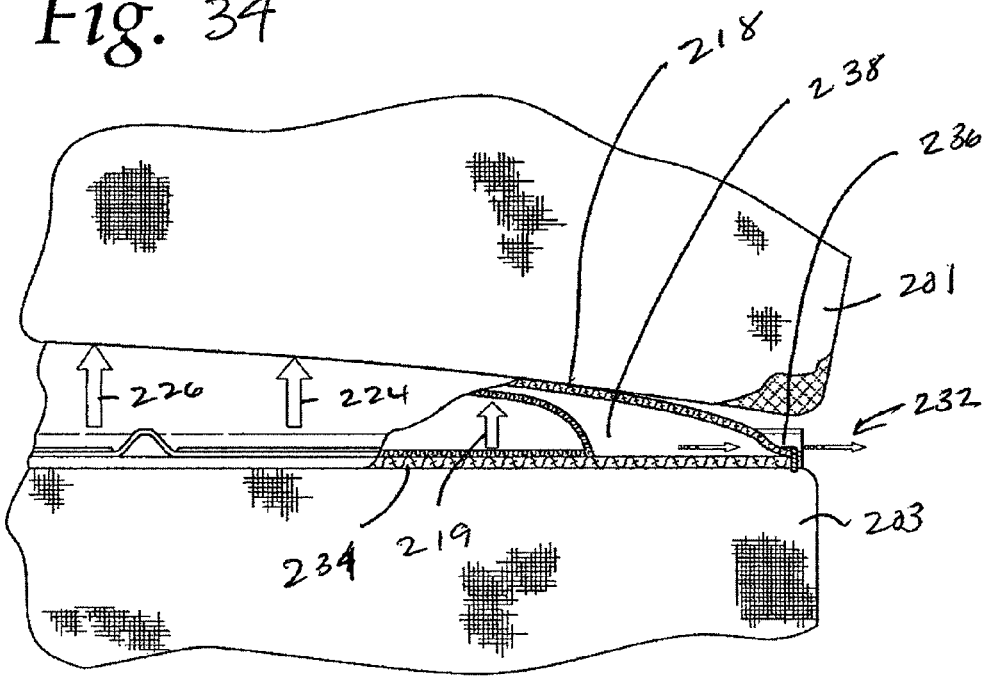
FIG. 34 is a partial side elevational view of the invention illustrated in FIG. 30, shown in an active position installed on a box spring.

The inflatable volume 202 includes an air inlet nozzle 204 and one or more vent holes, generally identified with the reference numeral 206. Four (4) vent holes are shown. More or fewer vent holes 206 could be used. The vent holes 206 are used to exhaust excess air from the inflatable volume 202 during an active mode when an air supply is applied to the air inlet nozzle 204 while maintaining the inflatable volume 202 in an expanded condition as shown in FIGS. 33 and 34.

One or more grommets or stitches 208 may be used to create one or more air pockets within the inflatable volume 202. As best shown in FIG. 33, the grommet 208 creates a donut shaped air pocket defining air pocket portions 210 and 212 when an air supply is connected to the air inlet nozzle 204 (FIG. 30). These air pocket portions 210, 212 lift the cover 218 and the upper mattress 201. Even though the pocket portions 210 and 212 do not extend to the edges of the sides 214 and 216, the mattress 201 tends to rise along the sides 214 and 216.

Turning back to FIG. 30, the levitation device 200 includes the inflatable volume 202 and a cover 218. As shown in FIGS. 30, 33 and 34, air is applied to the air inlet nozzle 204, as indicated by the arrow 217 (FIG. 33), for example, by way of an air pump 250 ((FIG. 39) in order to fill up the pocket portions 210 and 212 as indicated by the arrows 219 (FIG. 34), 220 and 222 (FIG. 33). Excess air is vented through the vent holes 208 (FIG. 30) to create an air cushion under the cover 218, as indicated by the arrows 224 and 226 (FIG. 34). This air cushion acting through the air pressure under the cover 218 may be used to support the upward force created by the expansion of the pockets 210 and 212 to lift the upper mattress 214, as shown in FIGS. 33 and 34. With a continuous air supply, the cover 218 is configured as a sieve to leak excess air, for example, around the perimeter, as generally indicated by the arrows 228 (FIG. 30), 230 (FIG. 32) and 232 (FIG. 34) when an air supply is connected to the air inlet nozzle 204. The sieve is configured so that the leakage from the top cover 218 and the air flow from the vent holes 208, for a given amount of air flow into the air inlet nozzle 204, is sufficient to maintain the air pocket portions 210, 212 (FIG. 33) in an expanded position, as best shown in FIG. 33. Once the bed is made, the air supply to the air inlet nozzle 204 (FIG. 30) is turned off. Subsequently, the air in the pockets is vented through the vent holes 208 and the sieve.

As mentioned above, the levitation device 200 includes an inflatable volume 202 and a cover 218 (FIG. 30). In an embedded embodiment, there are several embodiments for the inflatable volume. In one embodiment, the inflatable volume can be formed as a separate device and added to a standard box spring 203. In this embodiment, the inflatable volume 202 is formed from two (2) sheets 234, 235 of an air impermeable material, such as, PU coated nylon ripstop or PU/PVC coated nylon taffeta or material of similar or lesser air permeability. In this embodiment, the sheets are cut into an appropriate shape, such as a circle, as shown in FIG. 30, or other shapes, such as a rectangular or octagonal shape, shown in FIGS. 44 and 45, respectively or virtually any other shapes. Alternatively, the shape of the inflatable volume 202 can be created by sewing two (2) sheets together in a desired shape.

The air inlet nozzle 204 is also integrally formed in the sheets. The sheets are then fastened together in a desired shape, as discussed above, using a fastening method appropriate for the material used for the sheets, such as sewing for fabric sheets or for polymer based sheets, adhesives and/or heat sealing.

Figure 32:
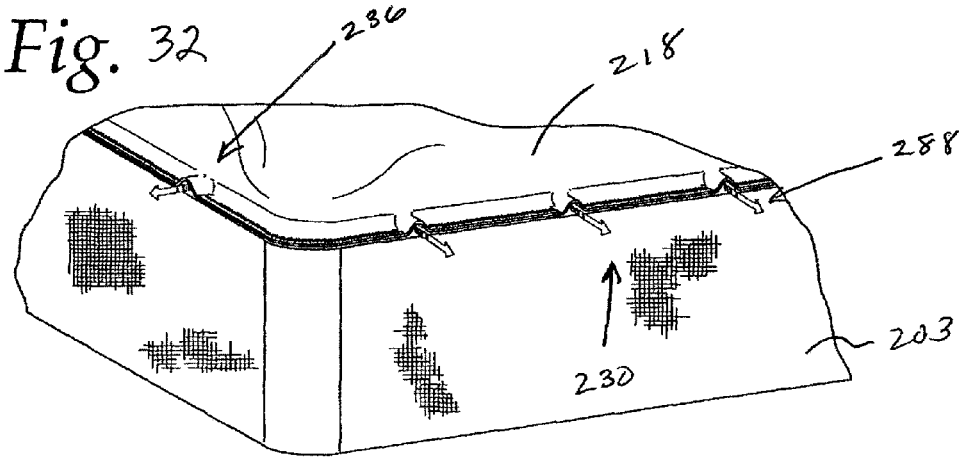
FIG. 32 illustrates an embodiment of the invention illustrated in FIG. 30 in which the levitation device is embedded in a box spring, shown with the mattress removed.

In an embodiment with an independent inflatable volume 244 (FIGS. 38-41), the inflatable volume can simply be placed on top of the box spring 203 so that air inlet nozzle 204 extends outwardly therefrom. Alternatively, the inflatable volume 202 (FIG. 30) may be secured to the underside of the cover 218 (FIG. 34) or secured to a top surface 234 of the box spring 203. In both embodiments, the cover 218 is secured to the box spring 203. As best shown in FIG. 32, the cover 218 is secured to the box spring 203 in such way to create a sieve by way of a plurality of air channels, generally identified with the reference numeral 236. As mentioned above, the sieve functions to exhaust excess air from under the cover, as indicated by the arrows 228 (FIG. 30).

The cover 218 simply rests on the inflatable volume 202 (FIG. 30) to enable the air released from the vent holes 206 to collect in the air pocket portions 238 and 240 (FIG. 33), formed between the inflatable volume 202 and the underside of the cover 218. The excess air in the air pocket portions 238 and 240 is expelled through the air channels 236 (FIGS. 32, 34). As defined herein, excess air means air pressure beyond the amount of air pressure required to lift the top mattress 201 (FIG. 33).

Alternatively, the inflatable air volume 202 can be incorporated into the top cover 218 or incorporated into the top surface 234 (FIG. 30) of the box spring 203. Incorporating the inflatable volume 202 can be accomplished in multiple ways. One way is to form the inflatable volume as an independent item from two sheets of material and to secure the inflatable volume 202 to either the cover 218 or the top surface 234 of the box spring 203 by suitable means, as discussed above.

Alternatively, the cover 218 or top surface 234 can be used to form a portion of the inflatable volume. In these embodiments, the cover 218 or top surface 234 of the box spring 203 is formed from an air impermeable material. In this embodiment, the inflatable volume 202, is formed by cutting a piece of air impermeable material in the shape of the inflatable volume 202 and securing it to the top cover 218 or top surface 234 of the box spring 203.

In addition to or in lieu of air impermeable material, a material may be used that is air permeable with a leakage rate comparable to leakage through the air channels 236 (FIG. 32). An exemplary material is nylon taffeta or polyester. In such an embodiment, the air channels 236 are eliminated and the top cover 218 is completely attached around the periphery of the box spring 203.

Figure 42:
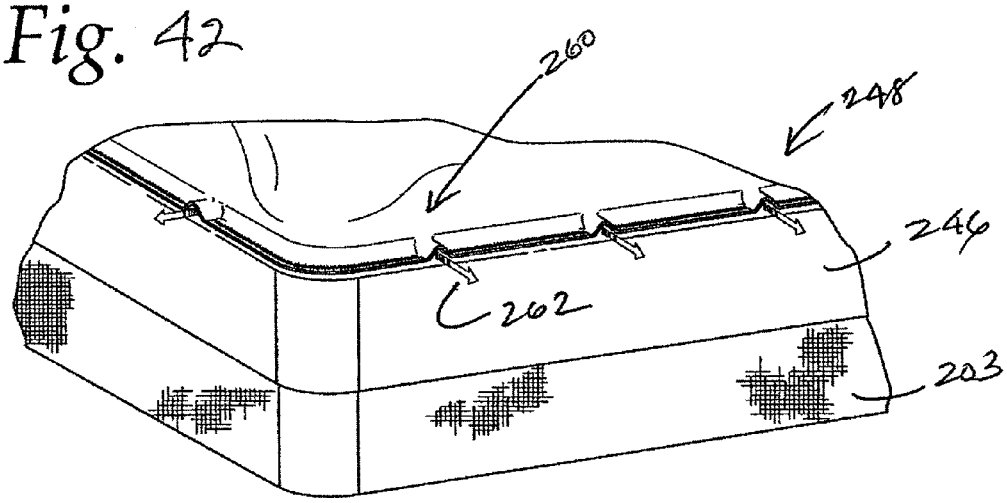
FIG. 42 is a partial isometric view of the single cover embodiment illustrated in FIG. 38 installed on a box spring and shown in an active mode of operation.
Figure 43:
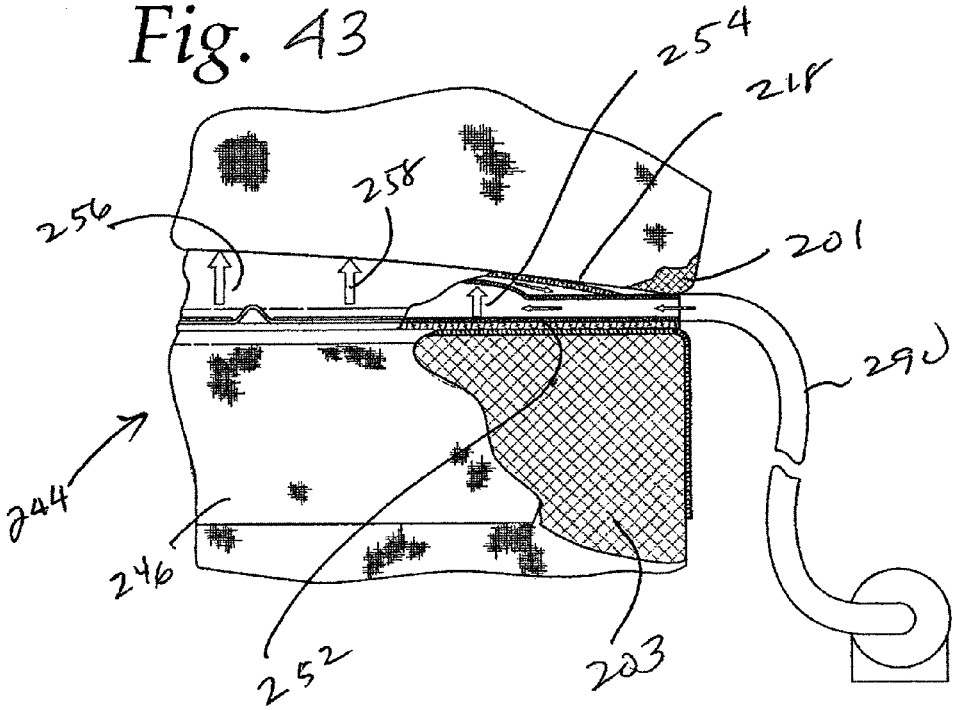
FIG. 43 is a partial elevation view of a single cover levitation device illustrated in FIG. 38 installed on a box spring with a mattress on top, shown with the levitation device in an active mode.

An alternate embodiment of the invention is illustrated in FIGS. 38, 39, 42 and 43. In this embodiment, the levitation device, generally identified with the reference numeral 242 includes an inflatable volume 244 and a cover 246. This embodiment is an aftermarket item that can be installed after a bed is purchased. In this embodiment, the cover 246 is formed as a fitted sheet to allow it to be installed by a consumer or housekeeper in a commercial facility after a bed has been purchased. The levitation device 242 may be fabricated as discussed above or below. As shown in FIGS. 42 and 43, the cover 246 may be formed with a plurality of air channels 248 or alternatively, as discussed above. The embodiment illustrated in FIGS. 38, 39, 42 and 43 operates in the same manner as the embodiment illustrated in FIGS. 30-37. In particular, with reference to FIG. 43, air from the air supply 250 is received into the inflatable air volume 244, as indicated by the arrows, generally indicated with the reference numeral 252 causing the pockets 254 within the inflatable air volume 244 to expand, thus lifting the cover 218, which, in turn, lifts the upper mattress 201, as shown and indicated by the arrows 256 and 258. As discussed above, excess air is vented through the vent holes (not shown) and moves between the inflatable volume 244 and the cover 248 and out air channels 260 formed in the cover 248, as indicated by the arrows 262 (FIG. 42), or alternatively as discussed above.

A third embodiment of the invention is illustrated in FIGS. 40 and 41. This embodiment is an after-market embodiment, generally identified with the reference numeral 266 and includes two covers 268 and 270. Both covers 268 and 270 are formed as fitted sheets and are both installed either the upper mattress 201 with air blowing down, as shown in FIG. 40 or on the box spring 203 with air blowing up, as shown in FIG. 41. The covers 268 and 270 may be formed as discussed below in connection with FIG. 5, or as discussed above. In this embodiment, excess air naturally escapes between the covers 268 and 270, thus eliminating the need for sieves.

Figure 35:
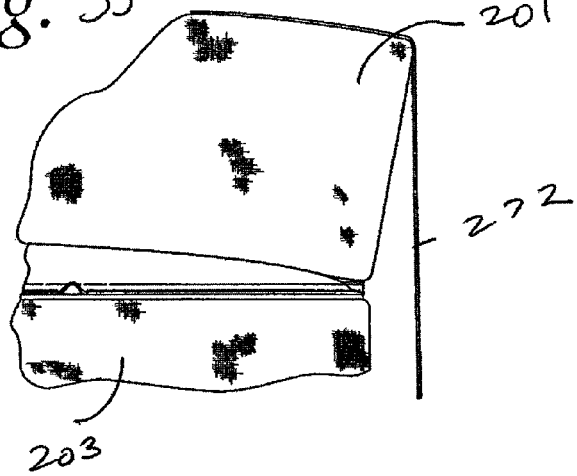
FIGS. 35-37 illustrate tucking of a sheet or blanket between a mattress and box spring with the aid of one embodiment of the levitation device in accordance with the present invention.
Figure 36:
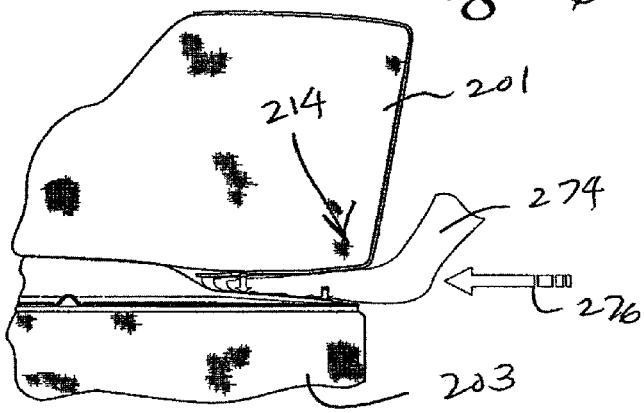
Figure 37:
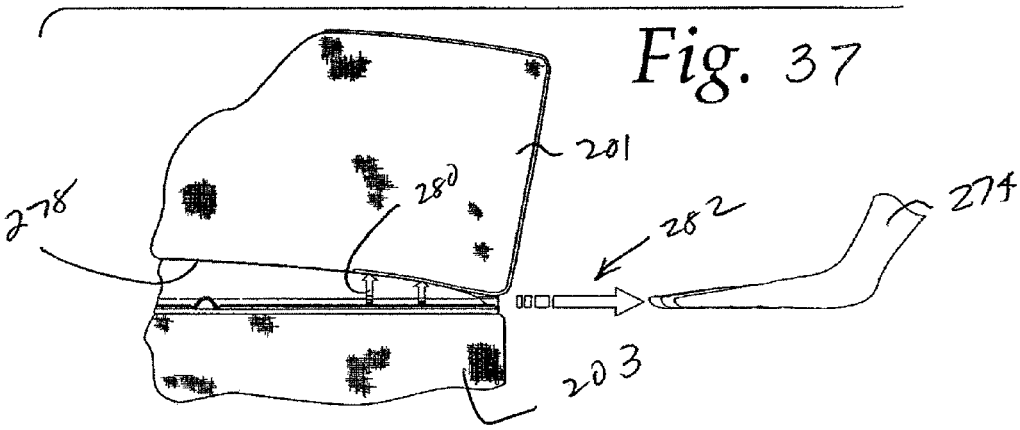
Figure 38:
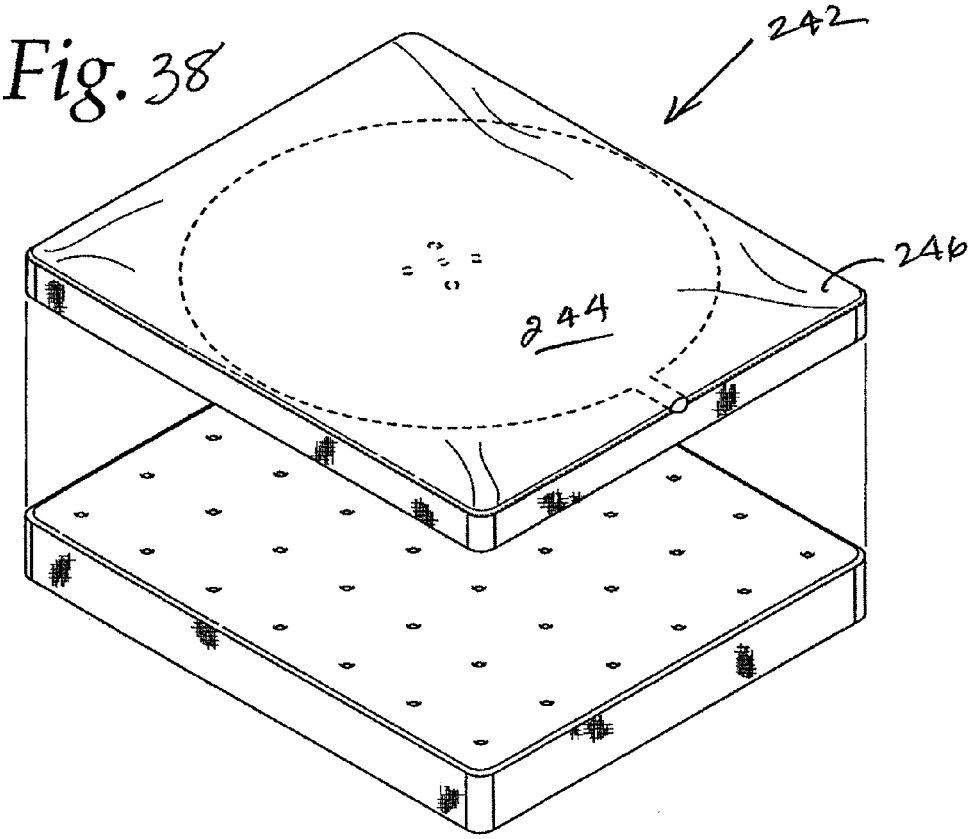
FIG. 38 is an exploded isometric view of an alternate embodiment of the levitation device illustrated in FIG. 30 in which the levitation device is configured as an after-market device that is installable on either mattress or the box spring in the same manner as a conventional sheet in which the levitation device is formed from a single cover.
Figure 39:
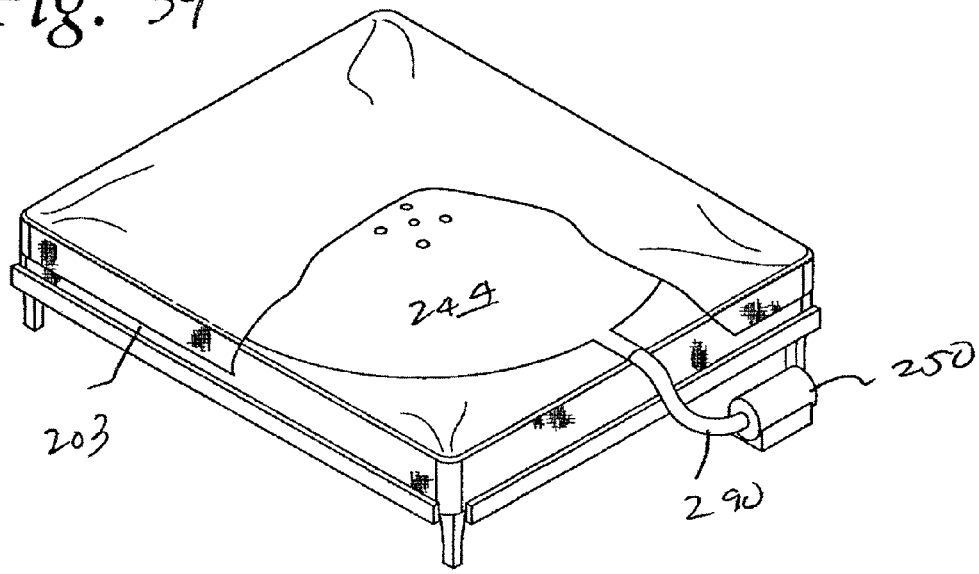
FIG. 39 illustrates the aftermarket levitation device, illustrated in FIG. 38, installed on a box spring.

All of the embodiments discussed above with respect to the embodiments of the invention for facilitating making a bed operate in a similar manner and are explained with reference to FIGS. 35-37. Referring first to FIG. 35, portions of the mattress 201 around the edges lift when the air supply 250

(FIG. 43) is attached to the air inlet nozzle 204 (FIG. 30) and turned on defining an active mode.

As shown in FIG. 35, a sheet or blanket 272 is shown dangling from an edge of the mattress 201. Next, as shown in FIG. 36. The free end of the blanket or sheet 272 is tucked between the mattress 201 and the box spring 203. Since the weight of the mattress 201 is being supported by the levitation device 200 (FIG. 30) and the edges of the mattress are slightly lifted, a consumer or commercial housekeeper is able to easily and virtually effortlessly slide their hand in the direction of the arrow 276 between the mattress 201 (FIG. 36) and box spring 203. As illustrated in FIG. 36, that action slightly lifts the edge 214 of the mattress 201 to enable the blanket or sheet 272 to be tucked between the top of the cover 218 (FIG. 30) and a bottom surface 278 (FIG. 37) of the mattress 201. The lifting force of the levitation device 200 (FIG. 30), as indicated by the arrows 280, holds the sheet or blanket 272 in place as the user's hand 274 is removed, as indicated by the arrow 282 (FIG. 37).

Figure 31:
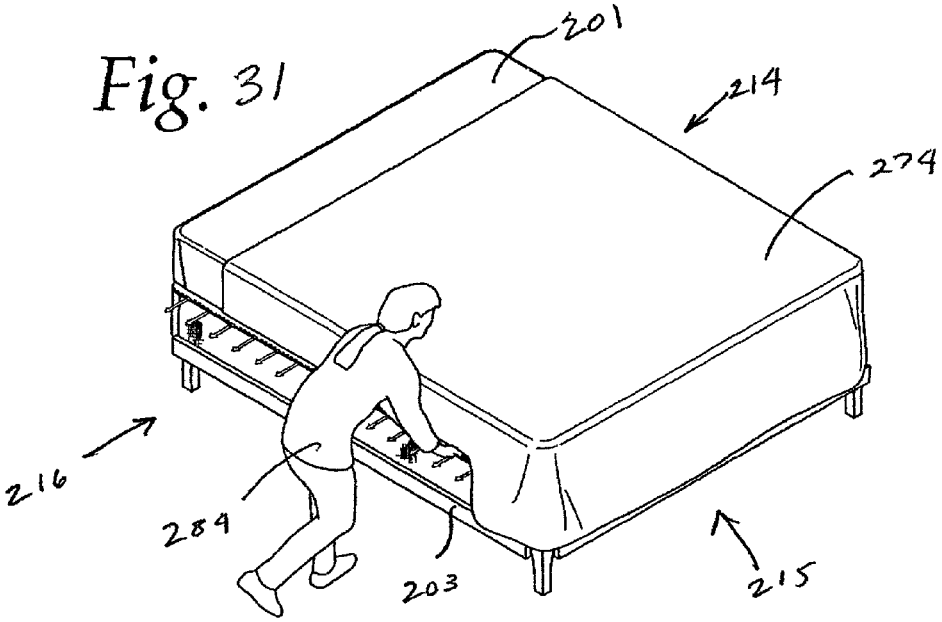
FIG. 31 illustrates a user tucking a sheet or blanket between a mattress and a box spring that incorporates the principles of the invention illustrated in FIG. 30.

As shown in FIG. 31, the user proceeds down the opposing side edges 214 and 216 as well as the foot end edge 215 tucking in a sheet or blanket 274. As the user proceeds down the sides edges 214 and 216 and the foot end edge 215, the portions of the blanket or sheet 274 are held in place. The tucking continues until the blanket or sheet 274 is completely tucked between the mattress 201 and the box spring 203. The corners, generally identified with the reference numeral 286 may be tucked in either before or after the side edges 214-216. FIG. 31 illustrates an exemplary application in which the corners on the foot end 215 of the bed are tucked in last.

As shown in FIG. 32, while the bed is being made, excess air is being expelled in the direction of the arrows, generally identified with the reference numeral 288, in a manner as discussed above. When the bed is made, the air supply 250 (FIG. 39) is turned off, defining a normal mode. In this mode, the mattress 201 rests firmly on the box spring 203. The air supply 250 and its conduit 290 may be disconnected from the air supply nozzle 204 (FIG. 30).

An important aspect of the invention illustrated in FIGS. 40 and 41 is that it is multi-functional and thus forms a hybrid device. More specifically, the embodiment illustrated in FIGS. 40 and 41 can be used to facilitate making a bed, as discussed above or alternatively to rotate a mattress. In order to take advantage of this aspect of the invention, both covers 268 and 270 are attached to one or the other of the mattress 201 or the box spring 203, defining a bed making mode, as discussed above. By flipping the cover 270 so that the cover 270 is attached to one or the other of the mattress 201 and the box spring 203 and the cover 268 is attached to the other of mattress 201 or the box spring 203, the invention can be used to rotate the mattress 201, as discussed below, defining a mattress rotation mode.

Levitation Device

The levitation device 200 includes an inflatable volume 202 configured in a circular pattern, for example, as illustrated in FIG. 30. The principles of the invention are also applicable to alternative patterns. For example, FIG. 44 illustrates a levitation device 300 with an inflatable volume 302 with a rectangular pattern. FIG. 45 illustrates a levitation device 310 with an inflatable volume 312 with an octagonal pattern.

Since the levitation devices 300 and 310 are essentially the same except for the pattern for the inflatable volume, only the levitation device 300 is described. Referring to FIG. 44 the levitation device 300 is formed with an inflatable volume 302 and air inlet nozzle 304, shown in phantom. The inflatable volume 302 includes one or more vent holes, as shown in phantom and generally identified with the reference numeral 306 and one or more grommets 308 or stitched, as discussed above. In the exemplary embodiment shown, the inflatable volume 302 is covered with a cover and formed as single cover aftermarket device, similar to the levitation device shown in FIG. 38, attached to a box spring 203.

The materials used for the hybrid embodiment illustrated in FIGS. 40 and 41 are the same as discussed below. The materials for the embedded embodiment illustrated in FIGS. 30-37 may be as set forth below may be PU coated nylon ripstop and/or PV coated nylon taffeta. The materials for the aftermarket embodiment illustrated in FIGS. 38 and 39 may be as set forth above

Mattress 360™

FIGS. 1-29 relate to device for facilitating rotation of a mattress in a horizontal plane carried by a box spring or a platform. A first embodiment of the device is illustrated in FIGS. 5-8. In this embodiment, in order to facilitate rotation of the mattress with respect to the box spring, slick surfaces between the mattress and the box spring or platform are selectively placed in contact in order to reduce the normal friction therebetween. The slick surfaces are provided by two (2) separate covers; a first cover for the box spring or platform and a second cover for the mattress. The first cover is provided with a slick surface and non-slick surface. In order to further facilitate rotation, a second cover includes a slick surface on one side which also includes part of a levitation device. The other side of the second cover may be formed with a slick or a non-slick surface. The levitation device creates an air column or cushion between the covers on the mattress and the box spring under the influence of an air supply which lifts the mattress and allows the mattress to be rotated in a horizontal plane virtually effortlessly. Once the mattress has been rotated to the desired position, the air supply is removed and the first cover is attached to the underside of the mattress so that its non-slick side is in contact with the box spring or platform or bed skirt and its slick side is in contact with the slick side of the other cover and the levitation device defining a normal mode of operation.

In a rotate mode of operation, the first cover is attached to the box spring or platform or bed skirt so that its non-slick surface is in contact therewith. Alternatively, as illustrated in FIGS. 16-23, the first cover may be integrally incorporated into the box spring or a slick surface may be integrally formed on the platform that forms part of the platform bed. In that embodiment, in order to prevent movement of the mattress with respect to the box spring or platform, the mattress is secured relative to the box spring or platform by removable fasteners in a normal mode of operation, as shown in FIGS. 19-23.

Figure 5:
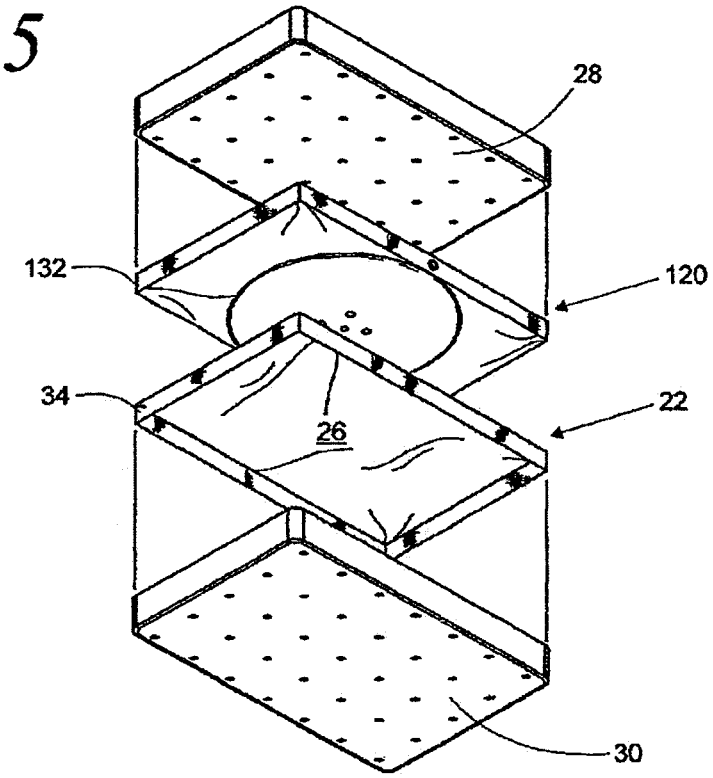
FIG. 5 is an exploded isometric view of one embodiment of the invention illustrating a conventional box spring and a conventional mattress and two covers in accordance with the present invention, shown with a portion of the levitation device integrated into one cover.
Figure 6:
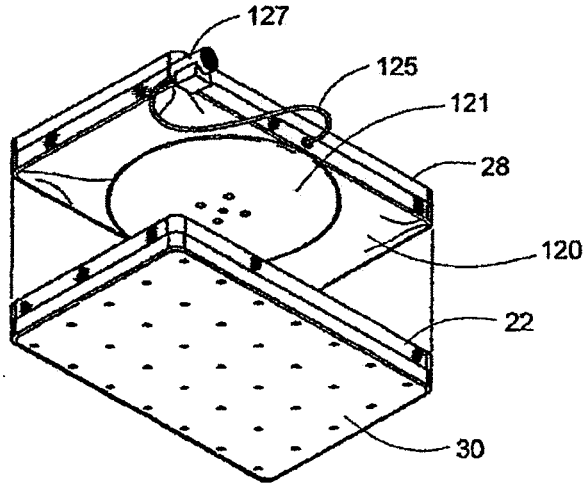
FIG. 6 is similar to FIG. 5 illustrating one of the covers shown in FIG. 5 installed on the mattress and one cover installed on the box spring.
Figure 7:
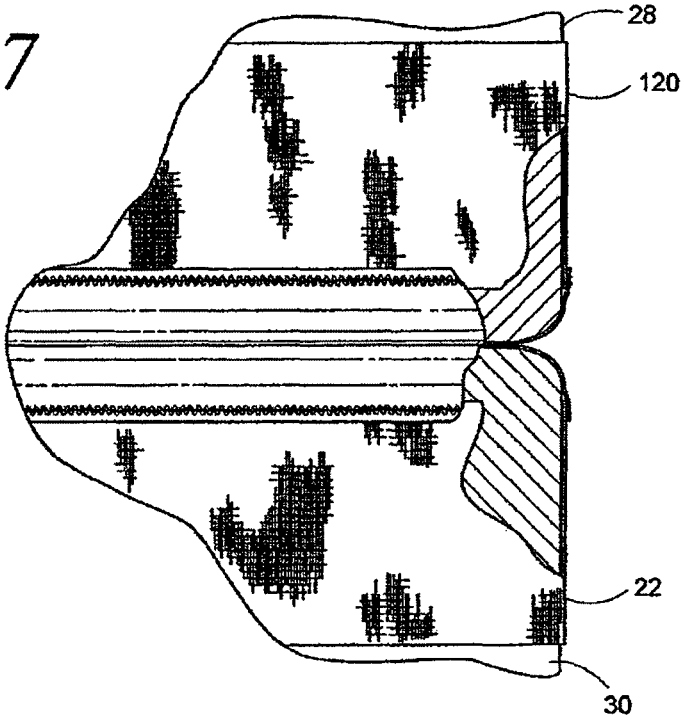
FIG. 7 is a partial side elevational view of the embodiment illustrated in FIG. 5, partially in section, illustrating one of the covers installed on the mattress and one cover installed on the box spring and shown in a rotate configuration in which the slick surfaces of the two covers are in contact with each other.
Figure 8:
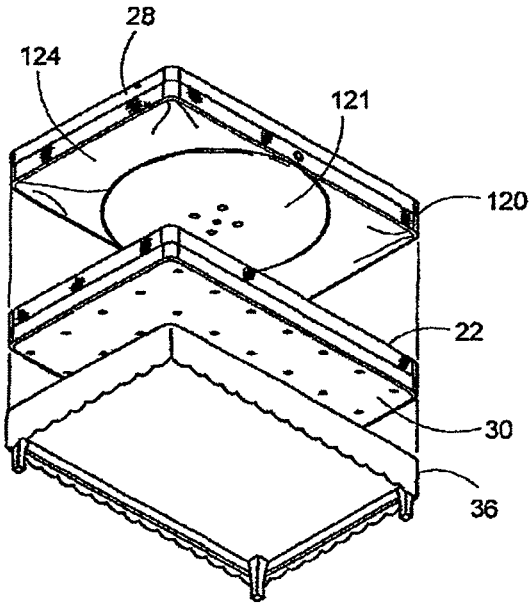
FIG. 8 is an exploded isometric view of an application of the invention illustrated in FIGS. 5-7 in which the bottom cover is to be placed over a bed skirt on the box spring securing it in place.

As best shown in FIG. 5, the first cover, identified with the reference numeral 22 includes a rectangular panel 26, configured to the size of a box spring 30. The cover 22 may include a stretchable band 34, attached to the periphery of the panel 26. The band 34, allows the cover 22 to be removably secured to the box spring 30, as generally shown in FIG. 6. The sides of the cover may be formed to be 9" deep and made of a PU coated polyester 1-way stretch (horizontal) material that fits tight around the mattress or box spring.

Figure 3:
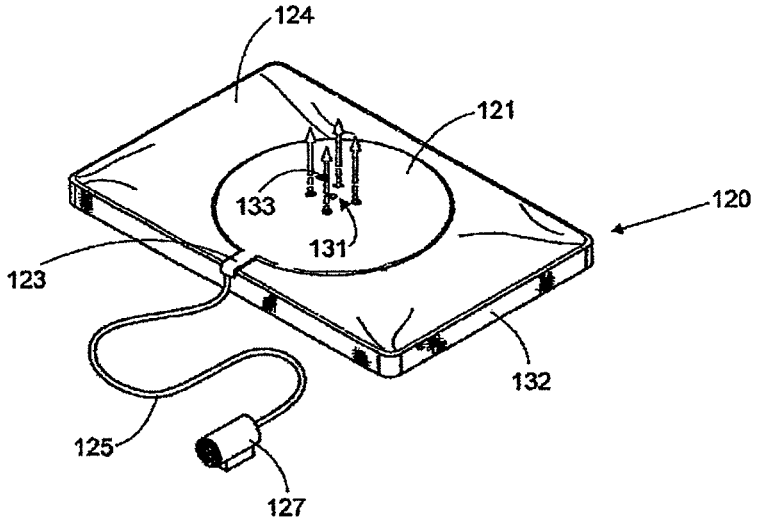
FIG. 3 is an isometric view of a levitation device for use with the present invention shown partially integrated onto one side of a cover.
Figure 4:
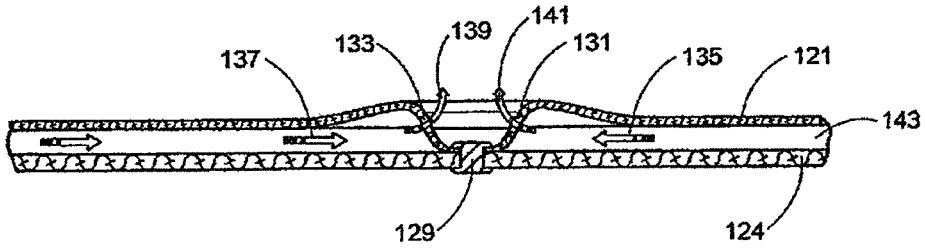
FIG. 4 is an elevational view of a portion of the levitation device illustrated in FIG. 3.
Figure 16:
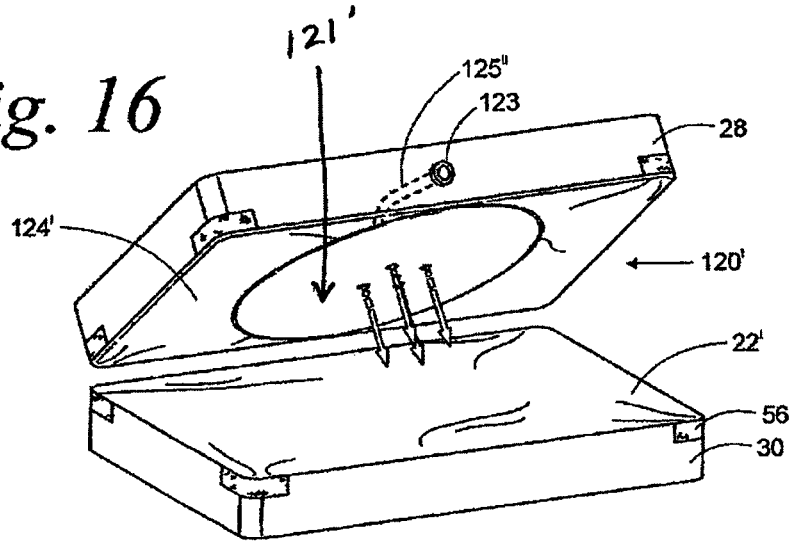
FIG. 16 is an alternate embodiment of the invention in which slick surfaces are integrated into the mattress and box spring along with a portion of the levitation device, shown with the mattress removed from the box spring and fastener strips integrated into the corners of the mattress and box spring.

The second cover, as best illustrated in FIGS. 3 and 4 and generally identified with the reference numeral 120, includes a panel 124, configured to the size of a mattress 28 (FIG. 16). The cover 120 includes a stretchable band 132, attached to the periphery of the panel 124. The band 132, allows the cover 120 to be removably secured to the underside of the mattress 28, as generally shown in FIG. 6.

The panel 124 and the band 132 portion of the cover 120 are similar to the cover 22 except that the cover 120 additionally includes an integrally formed levitation device. More particularly, an expandable air volume or bladder is formed in a portion of the cover 120. The expandable volume may consist of a top layer 121 being secured, for example, by sewing or other means, over a portion of the panel 124. As shown, the top layer 121 may be formed from the same material as the panel 124 and formed in virtually any shape, as discussed above, such as a circular shape, and generally centrally located with respect to the cover 120. The top layer 121 and the panel 124 are formed with a slick surface facing outwardly. The other side of the cover 120 may be formed with either a slick surface or a non-slick surface.

The expandable volume includes an air intake nozzle 123 (FIG. 3) and one or more air discharge holes, generally identified with the reference numerals 131 and 133. A grommet 129 (FIG. 4) or other fastening means to attach a center point of the top cover 121 to the panel 124, such as heat sealing, stitching, glue or the like, may be centrally located with respect to the top layer 121 and used to secure a one point on the top cover 121 to the panel 124 and create the expandable volume which includes the air channels, identified by the reference numeral 143 to create the air flow as illustrated by the arrows 135 and 137 from the nozzle 123 to the discharge holes 131 and 133.

Figure 1:
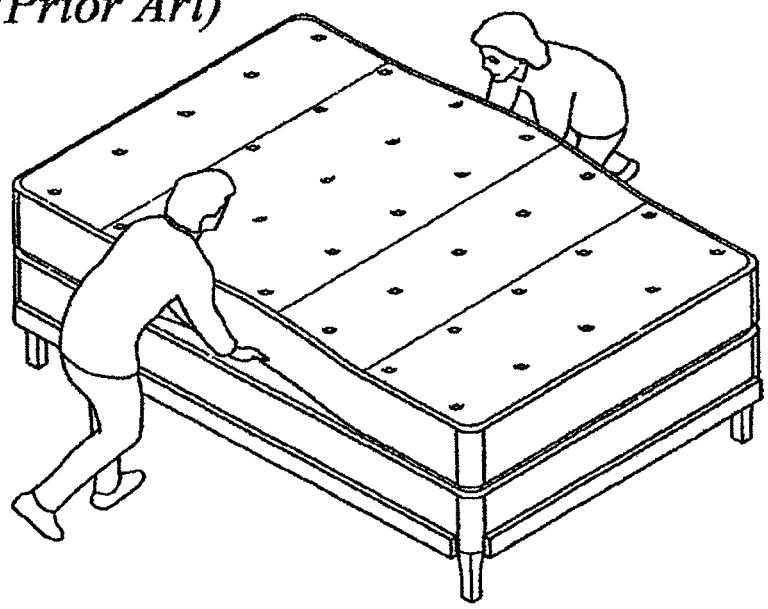
Fig. 1 (Prior Art)
FIG. 1 is an isometric drawing illustrating two people lifting a conventional mattress carried by a box spring in an attempt to rotate the mattress in a horizontal plane.
Figure 2:
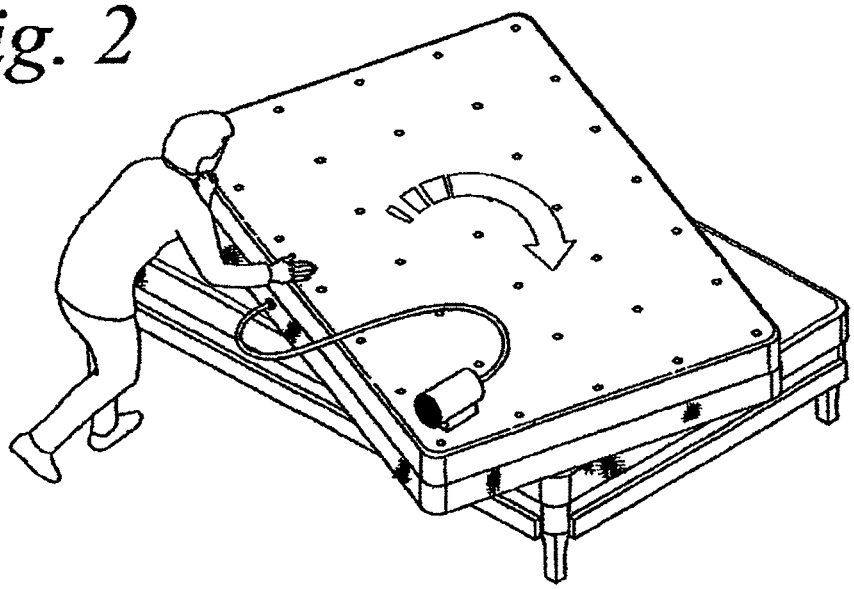
FIG. 2 is an isometric view of one person rotating a conventional mattress carried by a box spring incorporating the present invention, shown with the mattress partially rotated.

As shown in FIG. 4, once air is applied to the air intake nozzle 123 (FIG. 3), the expandable volume is inflated as shown and an air column to be formed adjacent the grommet 129. The air column lifts or levitates a surface in contact with the air column, such as a cover, whether or not embedded in the mattress 28, which, in turn, lifts a portion of the mattress 28 and relieving some of the weight along the periphery of the mattress 28. In as much as the slick surface of the cover 22 is in contact with the slick surfaces of the top cover 121 and the slick surface of the panel 124, the mattress 28 (FIG. 5) is virtually effortlessly rotated, as generally illustrated in FIG. 2. Once the mattress 28 has been rotated to the desired position, the cover 22 is attached to the mattress 28 causing its non-slick side to be contact with the box spring 30.

The bands 132 and 34 (FIGS. 3 and 5) may be formed from an elastic material, for example, spandex and other stretchable materials, such as mesh or an elastic banding and attached to the panels 124 and 26 respectively, for example, by sewing. Alternatively, the bands 32, 34 (FIG. 5) can be formed from a mesh or stretchable fabric. The bands 132 and 34 (FIG. 5) can be formed from the same material as the panels 124 (FIG. 3), 26 and secured to the mattress 28 and box spring or platform 30 by way of a drawstring (not shown) or other attachment method.

Figure 28A:
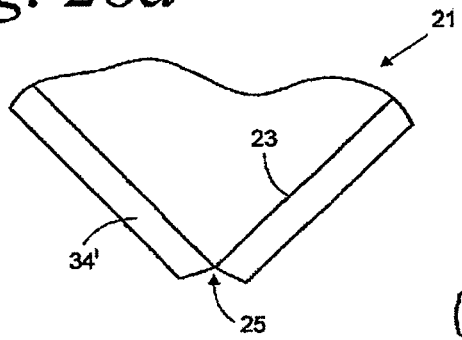
FIG. 28*a* is a partial isometric view of a material blank for use as a cover with the present invention, shown with fold lines on adjacent edges and an obtuse angle cut-out at one corner.
Figure 28B:
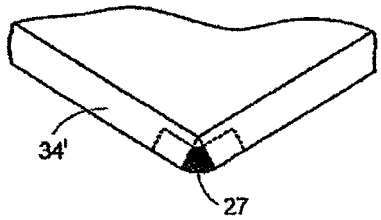
FIG. 28*b* is similar to FIG. 28*a* but illustrating an elastic material joining the strips defined by the fold lines and bridging the cut-out.

The bands 132 and 34 may also be formed by less labor intensive methods, as illustrated in FIGS. 28*a*-28*b* and FIGS. 29*a*-29*c*. The methods illustrated in these figures, reduce the amount of sewing and thus the labor involved. For simplicity, only one cover 22 is described and illustrated. However, these teachings also apply to the band 132 and panel 124 of the cover 120. Referring first to FIGS. 28*a* and 28*b*, one corner of a cover blank, generally identified with the reference numeral 21, is illustrated for simplicity. The cover blank 21 is formed as a generally rectangular piece of material with fold lines, generally identified with the reference numeral 23, adjacent to each edge of the rectangular piece of material. As shown in FIG. 28*a*, a piece of material is cut out of each corner defining, for example, an obtuse angle. The cut-out is identified with the reference numeral 25. The bands 34' are folded down as shown in FIG. 28*b*. A piece of flexible material, such as elastic, identified with the reference number 27, is used to bridge the cut-out 25. The flexible material 27 is secured to the ends of the contiguous bands 34'. As will be appreciated by those of ordinary skill in the art, the embodiment illustrated in FIGS. 28*a* and 28*b* significantly reduces the labor costs.

Figure 29A:
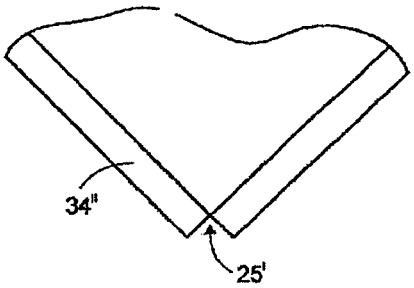
FIG. 29*a* is similar to FIG. 28*a* but illustrates a cut-out at other than an obtuse angle.
Figure 29B:
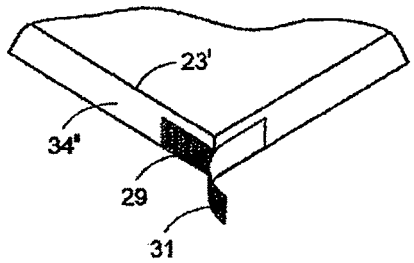
FIG. 29*b* illustrates the material blank illustrated in FIG. 29*a* with an integrated fastener strip on the strips defined by the fold lines shown with a cooperating removable fastener strip partially attached to the integrated fastener strip.
Figure 29C:
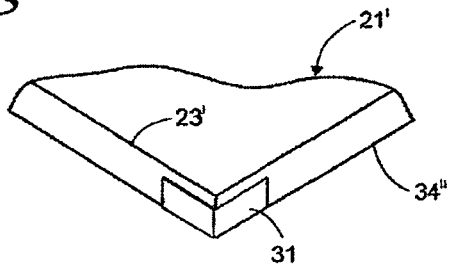
FIG. 29*c* is similar to FIG. 29*b* but shown with the removable fastener strip completely attached to the integrated fastener strip.

A second technique to reduce labor costs is illustrated in FIGS. 29*a*-29 *c*. In this embodiment, the corners of the material blank 21' are cut to form a cut-out 25' that is not an obtuse angle. The exemplary cut-out 25' is shown at roughly a 90 degree angle, In this embodiment, a fastener strip 29 is affixed to each end of the band 34", adjacent the cut-out 25'. A cooperating removable fastener strip 31 may be attached to the fastener strips 29 to secure the adjacent bands 34" together. The fastener strips 29 and 31 may be a Velcro® fastener or other type of fastener. The embodiment illustrated in FIGS. 29*a*-29*c*allows the material blank 21' to be juxtaposed over the mattress 28 or box spring 30 with the removable fastener strips 31, as least partially removed, for example, as shown in FIG. 29*b*. and secured to the exposed cooperating fastener strip 29, once the cover 20 is in place, as shown in FIG. 29*c*. angle. In this embodiment, a fastener strip 29 is affixed to each end of the band 34", adjacent the cut-out 25'. A cooperating removable fastener strip 31 may be attached to the fastener strips 29 to secure the adjacent bands 34" together. The fastener strips 29 and 31 may be Velcro or other type of fastener. The embodiment illustrated in FIGS. 29*a*-29*c* allows the material blank 21' to be juxtaposed over the mattress 28 or box spring 30 with the removable fastener strips 31, as least partially removed, for example, as shown in FIG. 29*b*. and secured to the exposed cooperating fastener strip 29, once the cover 20 is in place, as shown in FIG. 29*c*.

In accordance with an important aspect of the invention, the cover 22 (FIG. 5) may have a "slick" side having a relatively low co-efficient of friction and a non-slick side having a relatively higher co-efficient of friction. The other cover 120 which includes a portion of the levitation device has at least one slick side and may have two slick sides. As such, when the slick surfaces of the two covers 120 and 22 are selectively placed in contact with each other, the mattress 28 can be rotated in a horizontal plane with minimal effort by one person in a configuration defining a rotate mode of operation, as discussed in more detail below. The non-slick side of the cover 22 is used to selectively be placed in contact with an uncovered surface of the box spring 30. The non-slick side provides a the uncovered surface of the box spring 30, platform or bed skirt 36 in order to reduce if not prevent unintended rotation of the mattress in a normal configuration.

Various materials, such as cloth, and other materials that are bendable and amenable to being folded and stored in relatively small packages, are suitable for the panels 124, 26 for the covers 10, 22. The material for one cover 120, 22 need only have a slick side and a non-slick side. The non-slick side can be created on one side of a slick material by way of a coating or sewing or fusing a non-slick backing to one side of the non-slick material. Various conventionally available materials are suitable for the cover having a slick side and a non-slick side. For example, "30 Denier Heat Sealable (backside) 100% Nylon Rip Stop" material is suitable for use with the present invention or other materials with similar coefficients of friction on the slick and non-slick sides. Such material may be nylon, for example, 100% nylon with a coating on one side, for example, urethane or other thermal plastic or heat sealable coating. Such nylon rip stop material is known to come in widths of 58-62 inches wide and weighs about 1.9 to 4.4 ounces per square yard. Such material can easily be pieced together to accommodate various mattress widths if necessary.

Nylon rip stop material suitable for use with the present invention is available from various sources, such as, Quest Outfitters of Sarasota, Fla. questouffitters.com . Their nylon taffeta material is described in detail at questouffitters.com/coated,html#HEAT SEALABLE , hereby incorporated by reference. Suitable nylon taffeta material is also available from Rockywoods in Loveland, Colo. www.rockywoods.com. Their nylon taffeta material is described in detail at www.rockywoods.com/Fabrics-Hardware-Patterns-Kits/Medium-Weight-Nylon-Fabrics /Heat-Sealable-70-Denier-Nylon-Taffeta, hereby incorporated by reference.

No-woven materials may also be used for the cover 120, 22 having a sack side and a non-slick side. For example, Tyvek® polyethylene non-woven fabric, as manufactured by the DuPont Corporation and described in detail at www2.dupont.com/Products_and_Services/enVN/nwn.html may be used. Other materials having two slick sides can also be used, such as, silicone impregnated nylon rip stop, for example, as available from Seattle Fabrics, Inc., www.seattlefabrics.com/nylons.htm. Other materials can also be used with a coating applied to one side. Moreover, different materials can be used for each cover in an application.

Referring first to FIGS. 5-8, a first cover 22 is attached to a box spring 30 so that its non-slick side is in contact with the box spring 30 and its slick side is facing upwardly. The second cover 120 which includes a portion of the levitation device is attached to the underside of a mattress 28. In a rotate mode of operation, the cover 22 is attached to the box spring 30 so that its rough side is in contact with the box spring 30 and its slick side is facing upwardly so that its slick side is in contact with the slick surfaces 121 and 124 of the cover 120. In a normal mode of operation, the cover 22 is attached to the mattress 28 so that its rough side contacts the box spring 28 and its slick side contacts the slick surfaces 121 and 124 of the cover 120, thereby reducing unintended movement of the mattress 28 relative to the box spring 30 or bed skirt 36 or platform.

A small air supply 127 is connected to the air intake nozzle 123 by way of a conduit 125, as generally shown in FIG. 3. Since the force required to lift the mattress 28 is proportional to the pressure multiplied by the area of the mattress 28, the area of the top cover 121 may be divided into the total weight of the mattress 28 by the amount of pressure required by the air pump 160. As shown, the diameter of the top cover 121 may be selected to be slightly less than the width of the mattress 28, as shown, for example, in FIG. 3.

Figure 14:
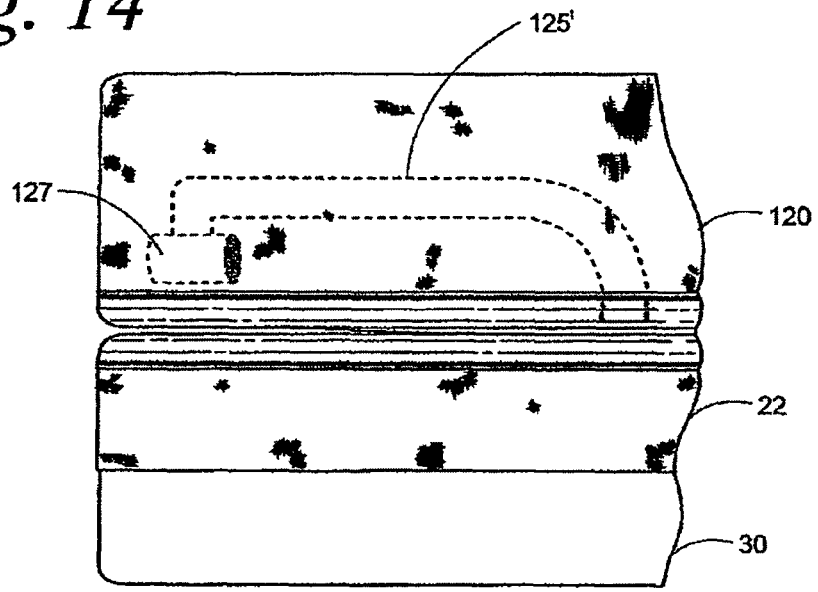
FIG. 14 illustrates an alternative embodiment of the system illustrated in FIG. 2 which includes an internal air pump built into the mattress, also illustrating the air conduit for supplying to an expandable air volume which forms a portion of the levitation device.
Figure 15:
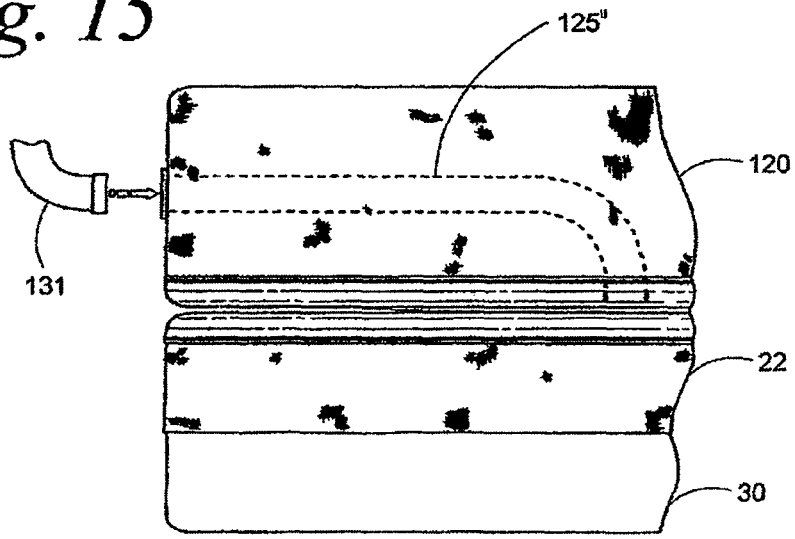
FIG. 15 is similar to FIG. 14 but illustrating an embodiment with an external air pump.

An alternate embodiment of the invention is illustrated in FIGS. 14 and 15. In this embodiment, a conduit 125' between the air intake nozzle 123 (FIG. 3) and the air pump 127 may be partially incorporated into the mattress 28. FIG. 16 illustrates yet another alternate embodiment in which includes an embedded conduit 125" the mattress 28 in that it is in fluid communication with the interior of the expandable volume and is connected to the air supply pump 127 (FIG. 3) external to the cover 120 by way of a connector 131.

Figure 9:
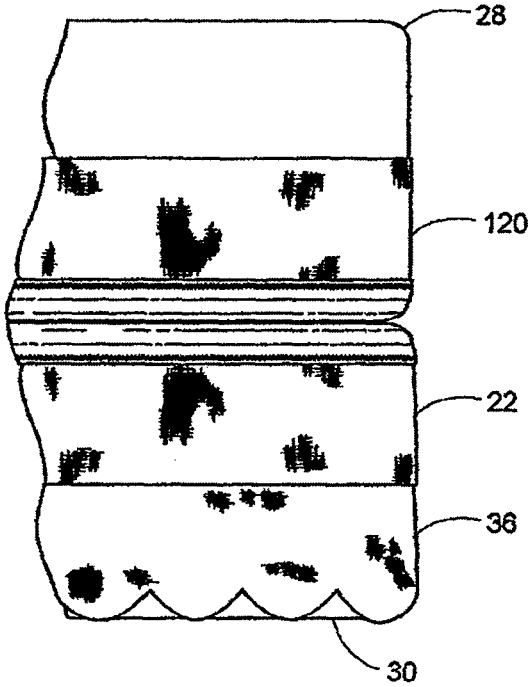
FIG. 9 is a partial side elevational view of the embodiment illustrated in FIG. 8, shown with one of the covers installed on the mattress and the other cover installed on the box spring illustrating a rotate configuration in which both slick surfaces are in contact with each other, illustrating the bottom cover installed over a bed skirt.

FIGS. 9-13 illustrate one application of the covers 120 and 22 in which a bed skirt 36 is draped over the box spring 30, as generally shown in FIG. 9. Heretofore rotation of a mattress 28 with a bed skirt 36 draped over the box spring 30 was a relatively cumbersome task. The present invention greatly simplifies rotation of the mattress 28 in such an application. More specifically, in this application, the cover 120 is attached to the underside of the mattress 28 so that its non-slick side or non-slick side, i.e. side not including the top cover 121, is in contact with the mattress 28 and its slick side, i.e. side including the top cover 121, is facing downward. The other cover 22 is attached to the box spring 30 over the bed skirt 36 so that its non-slick side is in contact with the bed skirt 36 and its slick side is facing upward, thereby placing the slick sides of the covers 120 and 22 in contact with each other, as shown in FIG. 9. The mattress 28 can then be rotated virtually effortlessly, as generally illustrated in FIG. 2.

Figure 10:
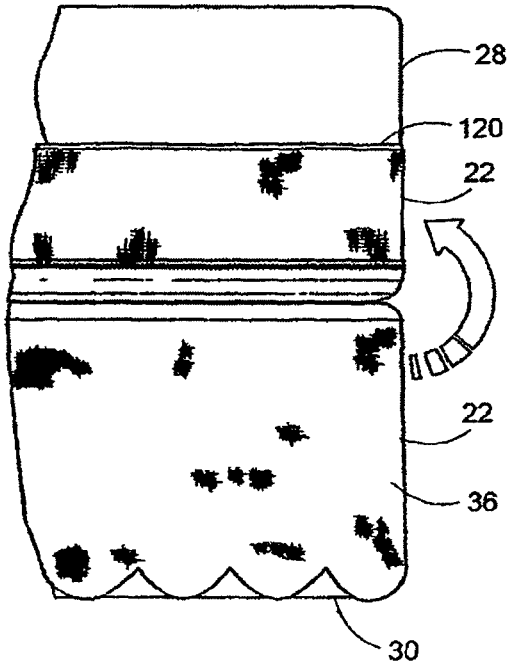
FIG. 10 is similar to FIG. 9 but shown with both covers installed on the mattress, illustrating a normal configuration in which a non slick surface of the bottom cover is in contact with the surface of the bed skirt.

After the mattress 28 is rotated to the desired position, the cover 22 is detached from the box spring 30 and attached to the mattress 28 over the cover 120, as shown in FIG. 10. This places the non-slick side of the cover 22 in contact with the bed skirt 36 to reduce if not prevent unintended rotation of the mattress 28. As shown in FIG. 10, the bed skirt 36 is uncovered and undisturbed since the cover 22 holds the bed skirt 36 in place during the rotation of the mattress 28.

Figure 11:
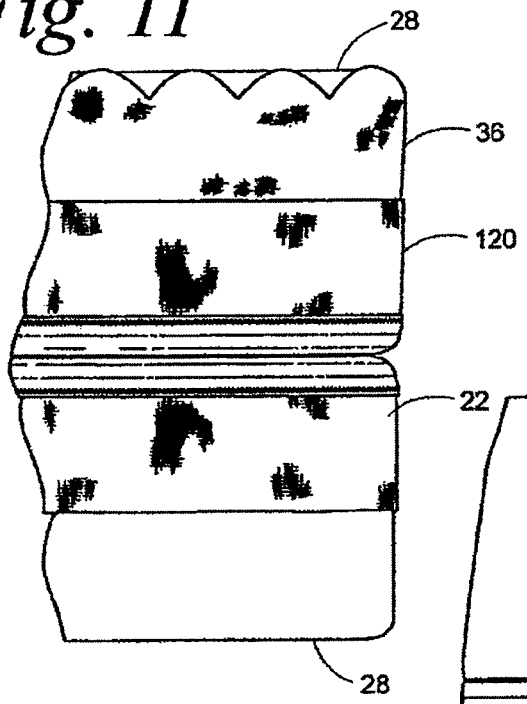
FIG. 11 is an alternative application of the embodiment illustrated in FIGS. 8-10 in which the bed skirt is used to hide both covers in a normal configuration, shown in a rotation configuration.
Figure 12:
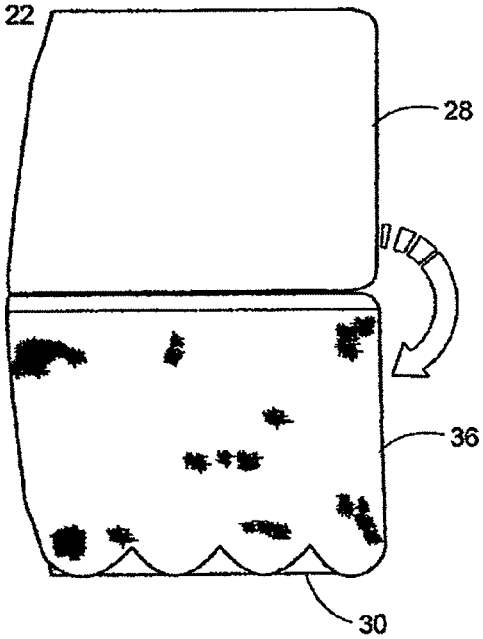
FIG. 12 is a partial elevational view of the application illustrated in FIG. 11 in a normal configuration in which the bed skirt is pulled down over the box spring hiding both of the covers.
Figure 13:
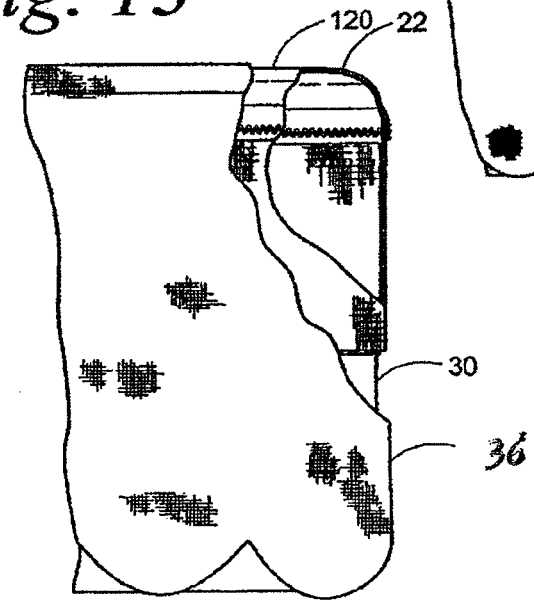
FIG. 13 is a partial elevational view of the box spring illustrated in FIG. 10, partially in section, shown in a normal configuration.

FIGS. 11-13 are similar to FIGS. 9 and 10 and illustrate another application in which the bed skirt 36 is used to hide the covers 120 and 22 in a normal configuration. Referring to FIG. 11, the bed skirt 36 is disposed around the mattress 28 so that its finished side is in contact with the mattress 28 and its unfinished side is facing outwardly. The cover 120 is attached to the mattress 28 over the bed skirt 36 so that its non-slick side is in contact with the bed skirt 36 and its slick side is facing downwardly. The other cover 22 is attached to the box spring 30 so that its non-slick side is in contact with the box spring 30 and its slick side is facing upwardly, thus placing the slick sides of the covers 120 and 22 in contact with each other. The mattress 30 can then be rotated in a horizontal plane virtually effortlessly by one person. Once the mattress 28 is in the desired position, the cover 120 is detached from the mattress 28 and attached to the box spring 30, over the other cover 22. This places the non-slick side of the cover 120 in contact with the underside of the bed skirt that is in contact with the mattress 28, thereby reducing unintended rotation of the mattress 28. Once the cover 120 is attached to the box spring 30, the bed skirt 36 is folded down over the box spring 30, thereby hiding both the first and second covers 120 and 22, as shown in FIGS. 12 and 13.

Figure 24:
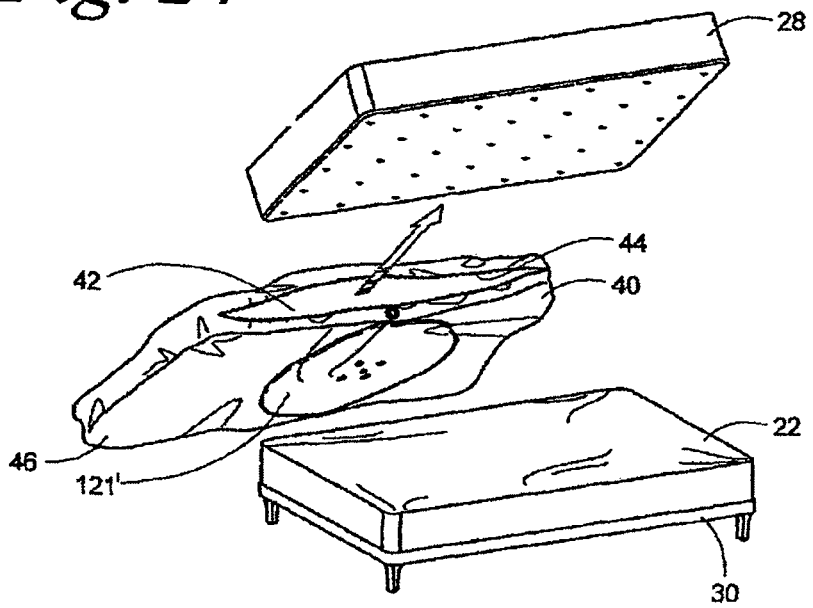
FIG. 24 illustrates an alternate embodiment of the invention in which the mattress cover is a protective cover having at least one slick surface, shown with the protective cover removed from the mattress and the mattress suspended relative to the box spring.
Figure 25:
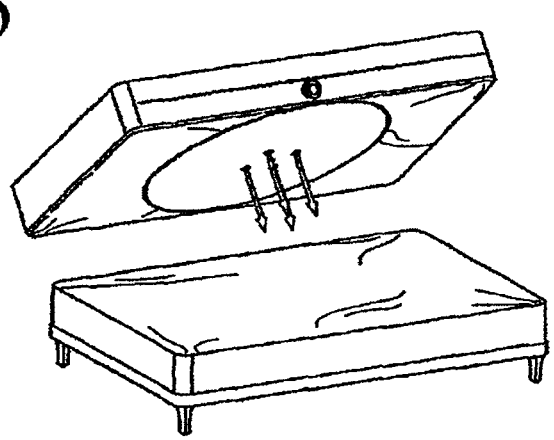
FIG. 25 is similar to FIG. 24 but shown with the protective cover installed on the mattress.

FIGS. 24 and 25 illustrate an embodiment in which the cover 120 is replaced with a protective cover 40, such as a waterproof cover, that encapsulates the mattress 28. The cover 40 is formed with a portion of the levitation device, as illustrated in FIG. 24 and discussed above. The protective cover 40 is to size and shape of the mattress 28 to provide a relatively snug fit. An opening 42 is provided along one edge of the protective cover 40 to enable the mattress 28 to be placed inside the protective cover 40 so that the levitation device is facing downwardly. A conventional fastener, such as a zipper 44 may be used to close the opening 42. In this embodiment, one surface 46 of the cover 40 is provided with a slick surface 46 as is the top cover 121' of the levitation device or top surface of the box spring 22 (FIG. 24).

With reference to FIG. 24, the mattress 28 and the cover 40 are configured so that the slick surface 46 faces the box spring 30. The cover 22 is formed with a slick surface and a non-slick surface. The cover 22 is attached to the box spring 30 so that its non-slick side is in contact with the box spring 30 and its non-slick side is facing upwardly. The slick side 46 of the cover 40 cooperates with the slick side of the cover 22 to facilitate rotation of the covered mattress 28 in a rotate mode. The cover 22 is as described above with a slick surface and a non-slick surface. More particularly, in a rotate mode of operation, the cover 22 is attached to the box spring 30 so that its non-slick surface is in contact with the box spring 30 and the slick surface faces upwardly in order to contact the slick surface of the protective cover 40. In this mode, the mattress 28 can be effortlessly rotated in a horizontal plane once the air pump 127 (FIG. 3) is turned on to fill and continue to feed the expandable air column with air creating a levitation effect.

In addition to the embodiments discussed above which require two covers, alternate embodiments are discussed below in which one or both of the covers 120 and 22 are integrally formed in the mattress or box spring 30, respectively. For example, as illustrated in FIGS. 16-23, one or both of the covers 120 and 22 may be eliminated and integrally formed in the mattress 28 or box spring 30. For example, assume that the cover 120 is integrally formed on the underside of the mattress 28. In this embodiment, the cover 22 is attached to the box spring 30 so that its non-slick surface is in contact with the box spring 30 and its slick surface faces upwardly in a rotate mode of operation. Once the mattress is rotated to the desired position, the cover 22 is attached to the mattress 28 so that its rough surface is in contact with the box spring 30 and its slick surface is in contact with the slick surfaces 121' and 124' of the cover 120' in a normal mode of operation.

Figure 17:
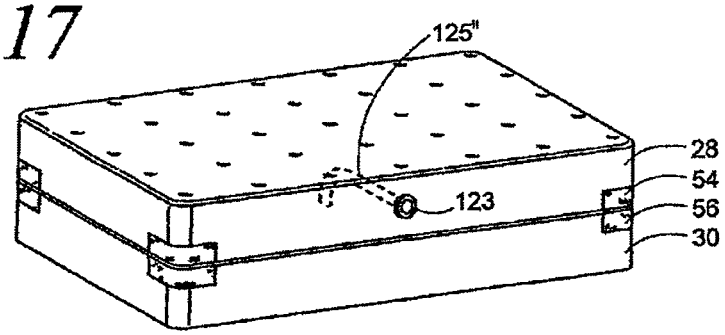
FIG. 17 is similar to FIG. 16 but shown with the mattress placed on the box spring illustrating integrated fastener strips aligned with one another.
Figure 18:
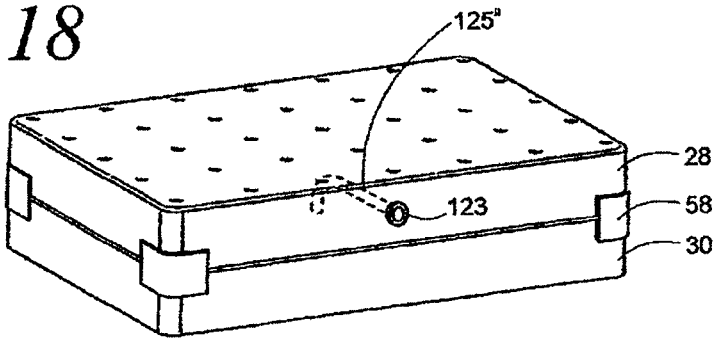
FIG. 18 is similar to FIG. 17, illustrating cooperating removable fastener strips attached to the integrated fastener strips in order to secure the mattress to the box spring.

Alternatively, as illustrated in FIGS. 16-18, both covers 120' and 22' can be integrally formed in the mattress 28 and box spring 30, respectively with their respective slick surfaces in constant contact. In this embodiment, the slick surfaces 121' and 124' of the cover 120' and the slick surface of the cover 22' is attached to the underside of the mattress 28 such that the slick surface faces downwardly and is in contact with the underside of the mattress 28. In a rotate mode of operation, the slick surface of the cover 120' is in contact with the slick surface integrally formed in the box spring 30.

Figure 19:
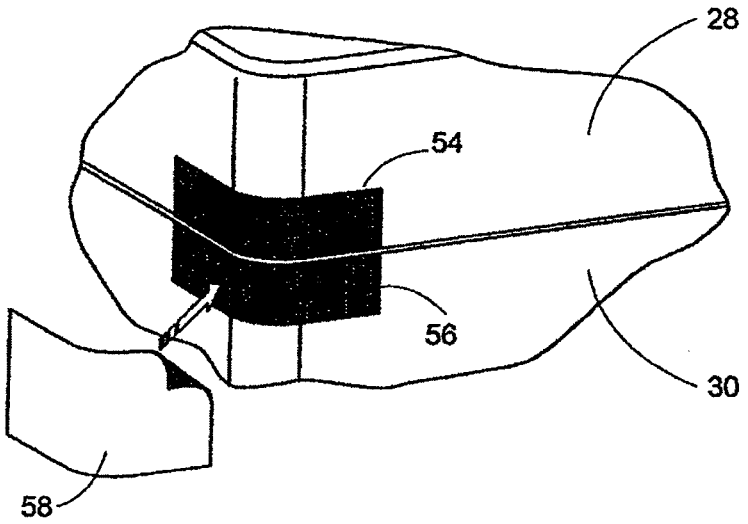
FIG. 19 is a partial elevational view illustrating one corner of a mattress disposed on a box spring illustrating integrated fastener strips aligned on each of the box spring and mattress, shown with a cooperating removable fastener strip removed.
Figure 20:
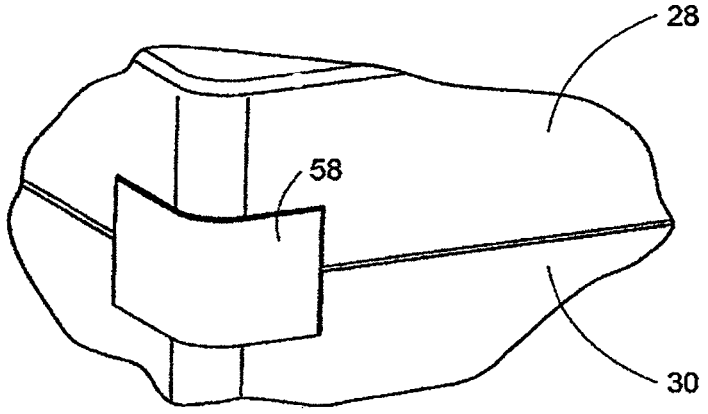
FIG. 20 is similar to FIG. 19 but shown with the removable fastener strip attached to the integrated fastener strips on the mattress and box spring.

In order to prevent movement of the mattress 28 with respect to the box spring 30 in a normal mode of operation, fasteners, for example, Velcro® fasteners, may be provided on the corners of both the mattress 28 and the box spring 30. In particular, permanent fastener strips 54 are provided on the corners of the mattress 28, as shown in FIGS. 16, 17 and 19. Similarly, permanent fastener strips 56 are provided on the corners of the box spring 30. As shown in FIGS. 17 and 19, when the mattress 28 is correctly aligned with the box spring 30, the permanent fastener strips 54, 56 on the mattress 28 are aligned with the permanent fastener strips 56 on the box spring 30. In order to secure the mattress 28 relative to the box spring 30, removable cooperating fastener strips 58 are selectively attached to the permanent fastener strips 54 and 56 as shown in FIGS. 18 and 20 defining a normal mode of operation. The removable fastener strips 58 are simply removed in order to rotate the mattress 28 and replaced once the mattress 28 has been rotated.

Figure 21:
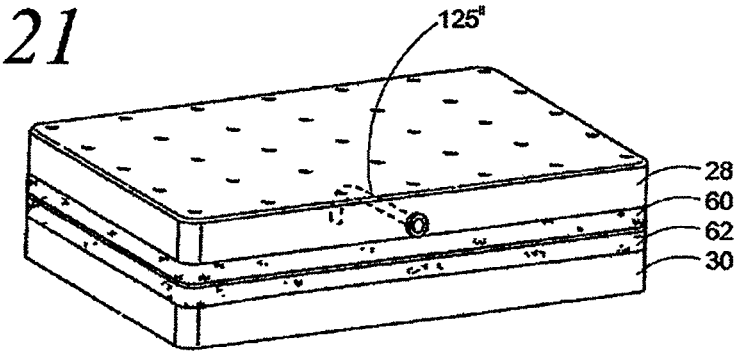
FIG. 21 is an isometric view of an alternative fastener configuration for securing the mattress to the box spring, illustrating a mattress disposed on a box spring in which the integrated fastener is disposed around the periphery of the box spring and the mattress, the mattress shown with an air inlet nozzle juxtaposed on a side of the mattress connected to a conduit, shown in phantom.
Figure 22:
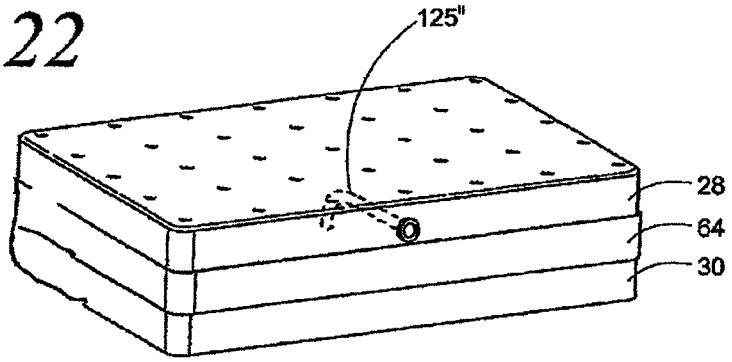
FIG. 22 is similar to FIG. 21 but shown with a cooperating removable fastener strip attached to the integrated fastener strips on the mattress and the box spring.
Figure 23:
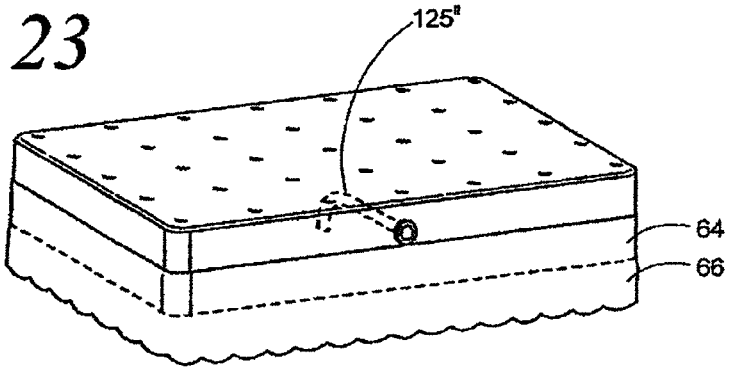
FIG. 23 is similar to FIG. 22 but illustrating a bed skirt which incorporates a removable fastening strip attached to the integrated fastening strips on the mattress and box spring.

Two alternate embodiments are illustrated in FIGS. 21-23. In the embodiment illustrated in FIGS. 21 and 22, permanent fastener strips 60 and 62 are located around the peripheries of the mattress 28 and the box spring 30, adjacent to the edges where the mattress 28 and the box spring 30 come together. As shown in FIG. 22, a cooperating removable fastener strip 64 is attached to the permanent fastener strips 60 and 62 on the mattress 28 and box spring 30, respectively. In yet another alternate embodiment as shown in FIG. 23, the cooperating removable fastener strip 64 may be affixed to the inside of a bed skirt 66. With such a configuration, not only are the mattress 28 and box spring 30 secured together, the configuration also allows a bed skirt 66 to be easily installed.

Figure 26:
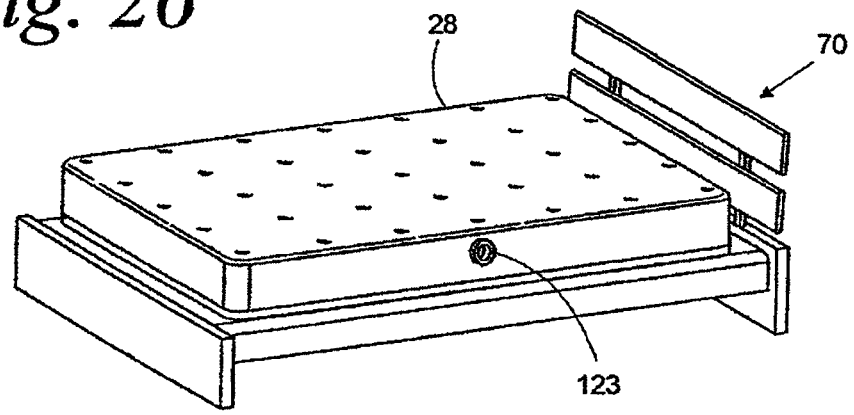
FIG. 26 is similar to FIG. 25 but illustrating a cover in accordance with the present invention installed on a platform forming a platform bed, shown with an air inlet nozzle juxtaposed on a side of the mattress.
Figure 27:
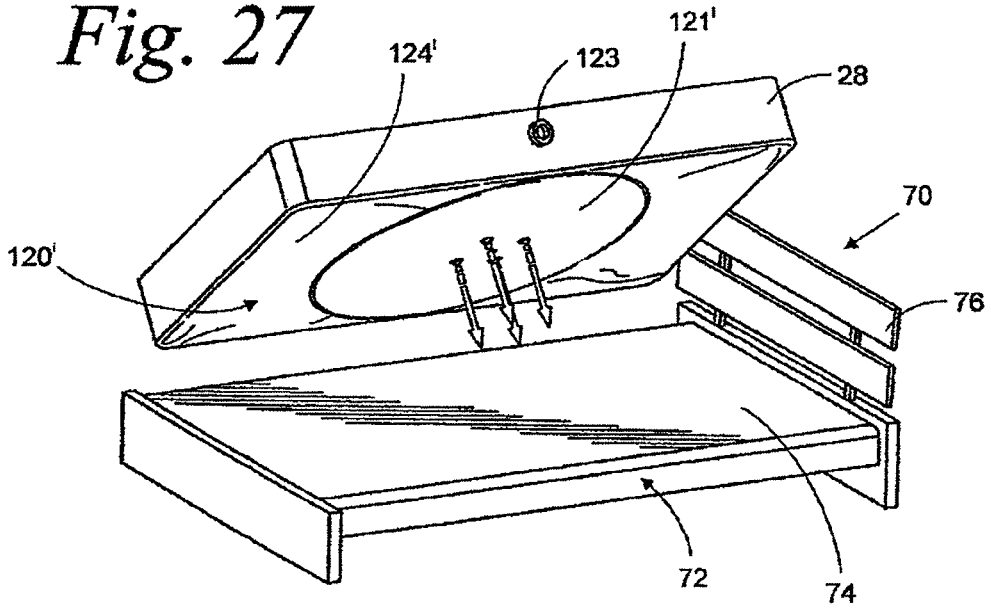
FIG. 27 is similar to FIG. 26 but showing the mattress with the cover in accordance with the present invention lifted from the platform.

FIGS. 26 and 27 illustrate an application of the invention on a platform bed, generally identified with the reference numeral 70. In this embodiment, the cover 120' is incorporated on the underside of a mattress 28 with the intake nozzle 123 terminated to one edge of the mattress 28. In this embodiment, the mattress 28 sits directly on a platform 72, which is formed with a slick surface 74 which cooperates with the slick surfaces 121' and 124' of the cover 120'. In a rotate mode of operation, air from an air supply (not shown) is applied to the intake nozzle 123 which causes the mattress 28 to levitate. The headboard 76 may be removed from the platform 74 or alternatively the mattress may be slid out away from the headboard and the mattress 28 before being rotated to its desired position. The air supply is then removed and the mattress returns to a rest position on the platform 72 and the headboard 76 is replaced in a normal mode. The mattress 28 is then secured to the platform 74 by a conventional fastener system.

Obviously, many modifications and variations of the present invention are possible in light of the above teachings. For example, the present invention can be utilized with only the cover 120. In this embodiment, the invention relies on the surface of the box spring 30 to cooperate with the levitation device. Also, the cover 22 can be provided with either two (2) slick sides or a slick side and a non-slick side. Thus, it is to be understood that, within the scope of the appended claims, the invention may be practiced otherwise than as specifically described above.

I claim:

1. A device for lifting a mattress that is supported by a box spring or platform, the device comprising:

a levitation device, configured to be disposed between a mattress and a box spring or platform, the levitation device having an inflatable volume and an air inlet for receiving pressurized air from an external air supply and at least one air discharge hole for continuously exhausting a portion of said air while said external air supply is supplying said pressurized air to said air inlet allowing said inflatable volume to expand and lift said mattress, said levitation device having a first sheet of material and a second sheet of material attached together along the periphery of at least one of said first sheet of material or said second sheet of material forming an inflatable volume, said first sheet of material and said second sheet of material further attached together away from said periphery by way of at least one attachment point that further secures said first sheet of material to said second sheet of material together.

2. The device as recited in claim 1 wherein said levitation device further comprises:

a first cover attached to said levitation device, said first cover configured to be removably attached to an underside of said mattress, or alternatively to said box spring or platform.

3. The device as recited in claim 1, wherein at least one of said first sheet of material or said second sheet of material is integrally formed as a cover that can be removably attached to said mattress box spring, or platform.

4. The device as recited in claim 1, wherein at least one of said first sheet of material or said second sheet of material form an integral part of an underside of said mattress.

5. The device as recited in claim 1, wherein at least one of said first sheet of material or said second sheet of material form an integral part of said box spring.

6. The device as recited in claim 1, wherein at least one of said first sheet of material or said second sheet of material form an integral part of said platform.

7. The device as recited in claim 1, wherein at least one of said first sheet of material or said second sheet of material form a cover.

8. The device as recited in claim 1, wherein at least one of said first sheet of material or said second sheet of material form a cover that is an integral component of an underside of said mattress.

9. The device as recited in claim 1, wherein at least one of said first sheet of material or said second sheet of material form a cover that is an integral component of said box spring.

10. The device as recited in claim 1, wherein at least one of said first sheet of material or said second sheet of material form a cover that is an integral component of said platform.

11. The device as recited in claim 1, wherein said levitation device is integrally formed as part of a cover that encases said mattress.

12. The device as recited in claim 1, wherein said levitation device is integrally formed as part of a cover that encases a foundation.

13. The device as recited in claim 1, wherein said levitation device is integrally formed as part of a cover that encases said platform.

14. The device as recited in claim 1, wherein at least one of said first sheet of material or said second sheet of material are an integral component of an underside of said mattress.

15. The device as recited in claim 1, wherein at least one of said first sheet of material or said second sheet of material are an integral component of said box spring.

16. The device as recited in claim 1, wherein at least one of said first sheet of material or said second sheet of material are an integral component of said platform.

17. The device as recited in claim 1, wherein at least one of said first sheet of material or said second sheet of material is formed to be the same size of said mattress, box spring, or platform and is removably attached to the sides of said mattress, box spring, or platform.

18. The device as recited in claim 1, wherein said levitation device is integrally formed as part of a cover configured to be removably attached to an underside of said mattress.

19. The device as recited in claim 1, wherein said levitation device is integrally formed as part of a cover configured to be permanently attached to an underside of said mattress.

20. The device as recited in claim 1, wherein said levitation device is integrally formed as part of a cover configured to be integrally formed as part of an underside of said mattress.

21. The device as recited in claim 20, wherein at least one of said first sheet of material or said second sheet of material is formed to be the same size as the mattress, box spring, or platform and is removably attached to said mattress, box spring, or platform.

22. The device as recited in claim 20, wherein at least one of said first sheet of material or said second sheet of material is formed to be less than the same size as the mattress, box spring or platform and is removably attached to said mattress, box spring, or platform.

23. The device as recited in claim 1, wherein said levitation device is integrally formed as part of a cover configured to be removably attached to said box spring.

24. The device as recited in claim 1, wherein said levitation device is integrally formed as part of a cover configured to be removably attached to said platform.

25. The device as recited in claim 1, wherein said levitation device is integrally formed as part of a cover configured to be permanently attached to said box spring.

26. The device as recited in claim 1, wherein said levitation device is integrally formed as part of a cover configured to be permanently attached to said platform.

27. The device as recited in claim 1, wherein said levitation device is integrally formed as part of a cover configured to be integrally formed as part of said box spring.

28. The device as recited in claim 1, wherein said levitation device is integrally formed as part of a cover and configured to be integrally formed as part of said platform.

29. The device as recited in claim 1, wherein said levitation device is integrally formed as part of a cover configured to be integrally formed as a top side of said box spring.

30. The device as recited in claim 1, wherein said levitation device is integrally formed as part of a cover configured to be integrally formed as a top side of said platform.

31. The device as recited in claim 1, wherein said levitation device is integrally formed as part of a cover configured to be permanently attached to a top side of said box spring.

32. The device as recited in claim 1, wherein said levitation device is integrally formed as part of a cover configured to be permanently attached to a top side of said platform.

33. A device for facilitating lifting of a mattress supported by a box spring or platform, the device comprising:

a levitation device formed from two sheets of material attached together around the periphery of at least one of said two sheets of material forming an inflatable volume configured to be disposed between said mattress and said box spring or platform, wherein one or both of said two sheets of material are formed as a cover sized to cover said mattress, box spring, or platform, said levitation device having an air inlet for receiving air from an external air source and an air discharge for continuously exhausting air, said two sheets of material secured together away from said periphery by way of at least one attachment point.

34. The device as recited in claim 33, wherein said cover can be removably attached to said mattress, box spring, or platform.

35. The device as recited in claim 33, wherein said cover is permanently attached to said mattress, box spring, or platform.

36. The device as recited in claim 33, wherein at least one of said two sheets of material form an integral part of an underside of said mattress.

37. The device as recited in claim 33, wherein at least one of said two sheets of material form an integral component of said mattress, box spring, or platform.

38. The device as recited in claim 33, wherein, at least one of said two sheets of material form an integral part of said box spring.

39. The device as recited in claim 33, wherein at least one of said two sheets of material form an integral part of said platform.

40. The device as recited in claim 33, wherein said levitation device is integrally formed as part of a cover that encases said mattress, box spring, or platform.

41. The device as recited in claim 33, wherein said levitation device is integrally formed as part of a cover configured to be removably attached to an underside of said mattress.

42. The device as recited in claim 33, wherein said levitation device is integrally formed as part of a cover configured to be permanently attached to an underside of said mattress.

43. The device as recited in claim 33, wherein said levitation device is integrally formed as part of a cover configured to be integrally formed as an underside of a mattress.

44. The device as recited in claim 33, wherein said levitation device is integrally formed as part of a cover configured to be removably attached to said box spring.

45. The device as recited in claim 33, wherein said levitation device is integrally formed as part of a cover configured to be removably attached to said platform.

46. The device as recited in claim 33, wherein said levitation device is integrally formed as part of a cover configured to be permanently attached to said box spring.

47. The device as recited in claim 33, wherein said levitation device is integrally formed as part of a cover configured to be permanently attached to said platform.

48. A device for facilitating lifting of a mattress supported by a box spring or platform, the device comprising:

a levitation device forming an inflatable volume to be disposed between a mattress and a box spring or platform, said levitation device including two sheets of material secured together along the periphery of at least one of said two sheets of material and further secured together at an attachment point away from said periphery, and further including an air inlet and an air outlet; and a cover sized to cover a mattress, box spring, or platform for covering an underside of a mattress, or alternatively a top surface of a box spring or platform, said levitation device attached to said cover so as to be disposed between an underside of said mattress and said box spring or platform.

49. The device as recited in claim 48, wherein said cover is removably attached between the underside of said mattress and said box spring or platform.

50. The device as recited in claim 48, wherein said levitation device is formed from two or more sheets of material and includes more than one attachment point spaced away from said periphery.

51. The device as recited in claim 48, wherein said levitation device includes at least two sheets of material and at least one of said two sheets of material forms an integral part of an underside of said mattress.

52. The device as recited in claim 48, wherein said levitation device includes at least two sheets of material and at least one of said two sheets of material forms an integral part of said box spring.

53. The device as recited in claim 48, wherein said levitation device includes at least two sheets of material and at least one of said two sheets of material forms an integral part of said platform.

54. The device as recited in claim 48, wherein said cover encases said mattress.

55. The device as recited in claim 48, wherein said levitation device includes two sheets of material and at least one of said two sheets of material form a cover that encases said mattress , box spring, or platform.

56. The device as recited in claim 48, wherein said levitation device is integrally formed as part of a cover configured to be permanently attached to an underside of a mattress.

* * * * *